US009493274B2

(12) United States Patent
Ledun et al.

(10) Patent No.: US 9,493,274 B2
(45) Date of Patent: Nov. 15, 2016

(54) STOPPER FOR A BOTTLE AND SEALING ELEMENT FOR SAID STOPPER

(71) Applicant: PATENT ROOM P5 S.a.r.l., Diekirch (LU)

(72) Inventors: Audrey Ledun, Valbonne (FR); Pieter Henderikus Langelaan, Escaldes-Engordany (AD);
(Continued)

(73) Assignee: PATENT ROOM P5 S.A.R.L., Diekrich (LU)

( * ) Notice: Subject to any disclaimer, the term of this patent is extended or adjusted under 35 U.S.C. 154(b) by 0 days.

(21) Appl. No.: 14/419,329

(22) PCT Filed: Aug. 5, 2013

(86) PCT No.: PCT/EP2013/002340
§ 371 (c)(1),
(2) Date: Feb. 3, 2015

(87) PCT Pub. No.: WO2014/019713
PCT Pub. Date: Feb. 6, 2014

(65) Prior Publication Data

US 2015/0210438 A1 Jul. 30, 2015

(30) Foreign Application Priority Data

| | | |
|---|---|---|
| Aug. 3, 2012 | (EP) | 12179272 |
| Mar. 14, 2013 | (EP) | 13159277 |
| Jul. 12, 2013 | (EP) | 13003543 |

(51) Int. Cl.
*B65D 39/08* (2006.01)
*B65D 39/00* (2006.01)
(Continued)

(52) U.S. Cl.
CPC ..... *B65D 39/082* (2013.01); *B65D 39/0047* (2013.01); *B65D 39/0064* (2013.01);
(Continued)

(58) Field of Classification Search
CPC ..... B65D 39/08; B65D 39/082; B65D 39/086; B65D 39/0064; B65D 39/12;
(Continued)

(56) References Cited

U.S. PATENT DOCUMENTS 694,013 A * 2/1902 Hayes ..... B65D 39/08 215/356
2,735,566 A 2/1956 Bramming
(Continued)

FOREIGN PATENT DOCUMENTS

DE 1877375 8/1963
DE 2721387 11/1978
(Continued)

OTHER PUBLICATIONS

"International Search Report for PCT/EP2013/002340 dated Aug. 11, 2015".
(Continued)

*Primary Examiner* — Robert J Hicks
(74) *Attorney, Agent, or Firm* — Kramer Amado P.C.

(57) ABSTRACT

A stopper for a bottle and a sealing element for sealing the stopper in the mouth of the bottle, which is separate from the bottle. The stopper comprises a stopper part for introduction into a mouth of the bottle, and a head part for remaining outside the mouth of the bottle, the head part having a diameter that is larger than that of the stopper part, wherein the stopper part comprises a an interlocking mechanism for engaging with a counterpart interlocking mechanism of the sealing element. The sealing element is forced against an inner wall of the mouth, thereby being brought into a sealed
(Continued)

position, upon introducing the stopper part into the mouth, in which sealed position the stopper is held on the bottle. The interlocking mechanisms permit bringing the sealing element into an unsealed position by an unsealing action which comprises rotating the stopper with respect to the bottle.

9 Claims, 16 Drawing Sheets

(72) Inventors: Reinhard Josef Helmig, Ringelai (DE)

(51) Int. Cl.
*B65D 39/12* (2006.01)
*B67B 1/06* (2006.01)

(52) U.S. Cl.
CPC ..... *B65D 39/12* (2013.01); *B67B 1/06* (2013.01); *B65D 2539/006* (2013.01)

(58) Field of Classification Search
CPC ..... B65D 39/00; B65D 1/0246; B65D 1/023; B65D 43/021; B65D 43/0227; B65D 43/0229; B65D 43/0225; B65D 43/0202; B67B 1/06; B67B 1/04; B67B 1/00; B65B 7/2828; B65B 7/2821; B65B 7/28
USPC ..... 215/356, 364, 360, 358, 355, 44, 43, 215/228; 220/789, 787, 784, 804, 803, 801, 220/802, 796, 212; 222/563; 53/471, 489, 53/490, 485, 476
See application file for complete search history.

(56) References Cited

U.S. PATENT DOCUMENTS

| | | | | |
|---|---|---|---|---|
| 2,940,629 | A | 6/1960 | Cros | |
| 3,015,403 | A | 1/1962 | Fuller | |
| 3,141,586 | A | 7/1964 | Wetterek | |
| 3,245,569 | A | 4/1966 | Essich | |
| 5,109,997 | A | 5/1992 | Phillips | |
| 5,947,310 | A | 9/1999 | Wagner | |
| 6,216,897 | B1 | 4/2001 | Wagner | |
| 6,536,618 | B1 | 3/2003 | Hwang et al. | |
| 2003/0062331 | A1* | 4/2003 | Lin | B65D 39/12 215/361 |
| 2004/0112856 | A1 | 6/2004 | Hwang et al. | |
| 2004/0169001 | A1 | 9/2004 | Leendersten et al. | |

FOREIGN PATENT DOCUMENTS

| | | | | |
|---|---|---|---|---|
| EP | 0244065 | A2 | 11/1987 | |
| GB | 190416631 | | 0/1905 | |
| GB | 1276485 | | 6/1972 | |
| GB | 1278909 | A * | 6/1972 | B65D 39/12 |

OTHER PUBLICATIONS

"EP Search Report for EP12179272.5 dated Nov. 30, 2012".
"EP Search Report for EP13003543.9 dated Nov. 6, 2013".
"EP Search Report for EP13159277.6 dated May 6, 2013".
"Tapon Hermitico Universal—Tapress", http://www.ideajit.com/ [viewed Feb. 3, 2015].

* cited by examiner

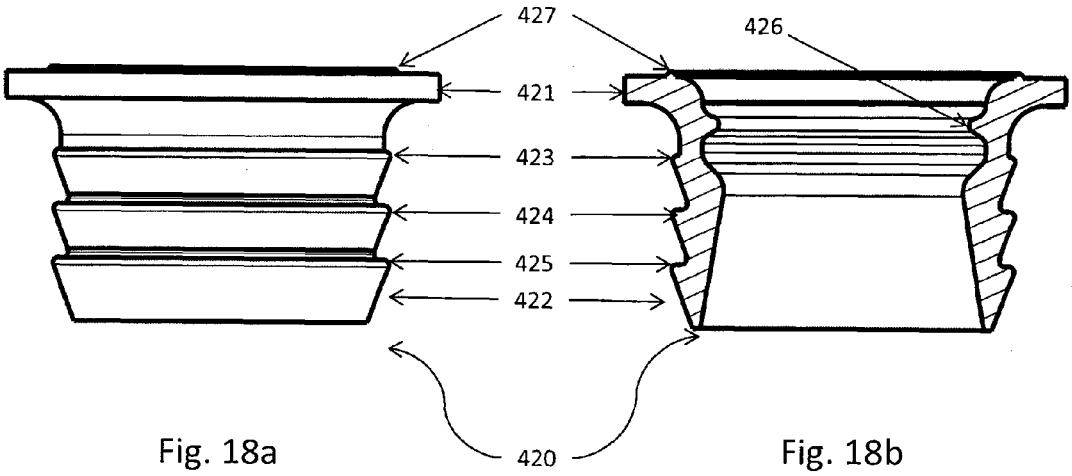
Fig. 18a
Fig. 18b
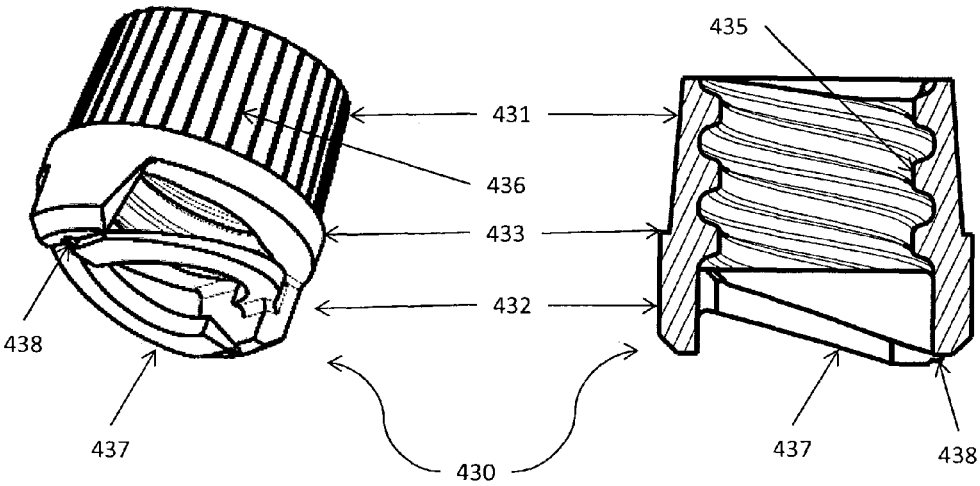
Fig. 19a
Fig. 19b

STOPPER FOR A BOTTLE AND SEALING ELEMENT FOR SAID STOPPER

FIELD OF THE INVENTION

The invention relates to a stopper for a bottle, preferably a beverage bottle, like a wine bottle, and a sealing element for sealing a stopper for a bottle. The invention further relates to a method of sealing a bottle.

BACKGROUND OF THE INVENTION

A sealable bottle is known from the European patents EP 1 451 081 B1 and EP 1 456 092 B1. A bottle disclosed in these patents comprises a stopper which is made of glass and can be inserted into the bottle opening. The bottle further comprises a fixing element that is attached to the bottle body in a detachable manner and retains the stopper inserted in the bottle opening in place.

Such a bottle presents several drawbacks. First of all, the fixing element attached to the bottle body comes at additional costs. Secondly, once the detachable fixing element is removed, e.g. when the bottle is opened for the first time, it can in general not be reattached. Therefore, proper sealing cannot be achieved any longer once the bottle has been opened.

As a consequence, it cannot be stored any more, e.g., in horizontal position. Thirdly, if the fixing element inadvertently comes off, for instance during transport, the stopper is not mechanically retained anymore and may easily come off as a result of increased internal bottle pressure.

Moreover, the closure systems disclosed in EP 1 451 081 B1 and EP 1 456 092 B1 present another drawback, when used in the wine industry for closing a wine bottle. Indeed, since the closure systems cannot cope with the manufacturing tolerances of ordinary wine bottles, these closure systems require a specific wine bottle, the mouth of which is specifically adapted to the shape and dimensions of the stopper. Therefore, wine producers wishing to adopt such a closure system for sealing their wine bottles instead of corks made of natural or synthetic cork will be forced to change their bottling processes and adapt them to these specific bottles, which are more expensive than standard bottles and are also only available from a few glass bottle manufacturers.

A bottle stopper arrangement which does not need a fixing element attached to the bottle is disclosed in U.S. Pat. No. 3,245,569. The bottle stopper arrangement described therein is specifically designed for a bottle in which a fluid is maintained under pressure, in particular a Champagne wine bottle. The bottle stopper arrangement comprises a tubular insert adapted to be secured in the mouth of the bottle, and a bottle stopper adapted to be inserted into the tubular insert. The tubular insert has an inner face defining a passage, the cross-sectional area of which decreases in the direction from its outer end in the mouth of the bottle and its inner end within the bottle. When the stopper is inserted into tubular insert, the insert is spread in the lower part, due to the decreased width of the passage in the lower part of the insert. By doing so, the spread lower part of the insert comes into an interlocking connection with the inner wall of the bottle neck because going downwards, the bottle neck widens up in the area of the spread lower part of the insert. The inner face of the tubular insert has at its outer end a screw-threaded annular surface portion and the bottle stopper has at its outer end a screw-threaded annular surface portion for engaging the screw-threaded annular surface portion of the inner face of the tubular insert. Due to the above-mentioned interlocking connection (which is supported by an additional interlocking connection outside at the rim of the mouth of the bottle), no fixing element is needed to hold the stopper securely on the bottle.

However, also the bottle stopper arrangement disclosed in U.S. Pat. No. 3,245,569 has several drawbacks. For example, it can only be used in combination with a specific bottle, the Champagne wine bottle, the inner wall of the bottle neck of which has an increasing diameter in the direction starting from the bottle mouth. The bottle stopper arrangement cannot be easily adapted to any bottle, for instance a bottle having a cylindrical bottle neck. Further, the tubular insert needs to be rather long, corresponding about to the length of a conventional wine bottle cork. Further, when the stopper is removed from the bottle, the insert stays on the bottle, which makes use of the bottle unpleasant. Further, at least two steps have to be carried out during for sealing the bottle in the bottling plant: in a first step, the insert needs to be put on the bottle, and only in a second step, the stopper can be placed on the bottle. The need for two steps makes bottling expensive. Further, the user needs to rotate the stopper over several turns before completely unscrewing the stopper, which makes the opening process cumbersome.

A stopper for necked bottles is disclosed in GB 1 276 485. The stopper arrangement described therein comprises a stem adapted to be inserted into the bottle neck, having a rotatable first member which moves a second member inside a stem. The stem has a cap with flexible tongues which increases in thickness of the when the second member moves on the stem. A sleeve and a sealing ring are provided for fluid tight. As it can be seen in FIG. 2 of GB 1 276 485, of the document, the increased displacement of the cap, and thereby the displacement of the sleeve is provided in the lower part.

However, the stopper disclosed in GB 1 276 485 has various drawbacks such as for the process of sealing, it is required that the stopper is placed in the bottle and rotated since it would not be possible to insert an already assembled and sealed stopper due to its large sleeve and increased displacement at the lower part.

Due to the need for rotating the stopper after it is placed inside the bottle, the method of bottling would therefore require two steps: in a first step, the stopper along with all the components has to be put on the bottle, and in a second step, the stopper needs to rotated multiple times to reach a sealed state. This need for two steps makes bottling expensive.

A stopper in GB 26 631 teaches a stopper having a core and covered with a sheath. However one drawback of this stopper is that the sheath is provided in the entire surface of the core, thereby requiring the core to be placed on the sheath inside the bottle and then rotated. This requirement of rotation during bottling makes the bottling method expensive.

Another drawback of the system in the above prior art documents having a sealing element between the stopper and the bottle such as in GB 1 276 485 and GB 26 631 is that a gap formed between the stopper and the bottle due to the placement of the sealing element. This gap creates accumulation of dirt and dust and therefore causes unhygienic circumstances.

Furthermore, none of the closure systems without a capper or the like on the top of the stopper such as U.S. Pat. No. 3,245,569, GB 1 276 485 or GB 26 631 have any indication provided to the user if the stopper has been used earlier and if the bottle has been opened after bottling, since it does not have a tamper proof mechanism.

SUMMARY OF THE INVENTION

It is therefore the object of the invention to provide a closure system for a bottle that overcomes any or all of the above-mentioned drawbacks of the systems known from EP 1 451 081 B1, EP 1 456 092 B1, GB 1 276 485, GB 26,631 and U.S. Pat. No. 3,245,569. In particular, it is an object of the invention to provide a closure system for a bottle which allows making the sealing of the stopper in the bottle sufficiently strong for transportation and/or storage of the bottle at a high temperature and/or in horizontal position even in the absence of a fixing element attached to the bottle body. Further, it is an object of the invention to provide a closure system for a bottle which can be used with bottles ordinarily used by producers for bottling their products, without requiring a specific bottle. Further, it is an object of the invention to provide a closure system which allows for an inexpensive process of sealing the bottle in the bottling plant. Further, it is an object of the invention to provide a tamper proof mechanism which can be used in the absence of a capper or the like on top of the stopper. Further, it is an object of the invention to provide a bottle to overcome the drawbacks of the prior art systems associated with a gap between the stopper and the bottle caused by the sealing element.

Some or all of these objects are solved by the subject matter of the independent claims. Preferred embodiments are subject to the dependent claims.

A first embodiment of the invention provides a stopper for a bottle designed for commercial bottling of a beverage or liquid food, preferably a wine bottle, comprising a stopper part for introduction into a mouth of the bottle, and a head part for remaining outside the mouth, the head part having a diameter that is larger than that of the stopper part, wherein the stopper part comprises an interlocking mechanism for engaging with a counterpart interlocking mechanism of a sealing element, which is separate from the bottle, wherein the sealing element is configured to be forced against an inner wall of the mouth, thereby being brought into a sealed position, upon introducing the stopper part into the mouth, and wherein the interlocking mechanisms are configured to permit bringing the sealing element into an unsealed position by an unsealing action which comprises rotating the stopper with respect to the bottle.

Since the sealing element is separate from the bottle, standard bottles without any specifically adapted mouth (e.g. without an internal threading in the mouth) can be used. The stopper is firmly held to the bottle to such an extent that preferably so that no additional fixing means is required for transportation or storage.

Further, since the stopper part and the sealing element comprises interlocking mechanisms, this permit bringing the sealing element to an unsealed position by an unsealing action not requiring excessive forces. The unsealing action comprises among others, a rotating action of the stopper. Therefore, the sealing element can comfortably be brought into an unsealed position even if the seal is made very strong, in fact so strong that the user would not be able to open the bottle by pulling the stopper in the longitudinal direction. Furthermore, it allows the seal to be made so strong that it compensates for manufacturing tolerances of the manufactured bottles, e.g. standard wine bottles. The interlocking mechanism between stopper and sealing element could be, e.g., a screw thread or a bayonet fitting.

The head part of the stopper remains outside the mouth of the bottle so that the user can turn the stopper without the need of a tool like a screwdriver. Furthermore, the head part has a diameter that is larger than that of the stopper part. Such an enlarged head part ensures that the head part remains outside, and allows for easier rotation of the stopper due to a greater leverage force.

According to a second embodiment of the invention, in the first embodiment, in the sealed position, the stopper is held on the bottle by way of a frictional connection only.

The stopper according to the invention is held in the sealed position (only) by way of a frictional connection between the sealing element and the inner wall of the mouth of the bottle, without an interlocking connection between the sealing element and the bottle. The seal can be made so strong (e.g. by choosing appropriate dimensions of the stopper and the seal with respect to the mouth of the bottle) that the bottle can be transported and/or stored in a horizontal position without a fixing element attached to the bottle body.

According to a third embodiment of the invention, in the first or second embodiment, the interlocking mechanism comprises a screw thread.

According to a fourth embodiment of the invention, in any of the preceding embodiments, the interlocking mechanism comprises a plurality of screw threads extending parallel to each other for engaging with the sealing element. A stopper according to the third embodiment of the invention provides the additional advantage that the engagement of the corresponding screw threads with the screw threads of the stopper is made easier. For example, with two parallel screw threads, the stopper needs to be rotated less than 180 degrees with respect to the sealing element for finding the next "entry point" of engagement. Furthermore, having a plurality of screw threads makes it easier that the screw threads are relatively short, e.g. extend less than the full circumference of the stopper part.

According to a fifth embodiment of the invention, in the fourth embodiment, the number of screw threads is two to six.

According to a sixth embodiment of the invention, in the fourth or fifth embodiments, each screw thread extends less than a full circumference of the stopper part.

According to a seventh embodiment of the invention, in the sixth embodiment, each screw thread extends not more than essentially half a circumference of the stopper part. A stopper according to the seventh embodiment of the invention provides the additional advantage that that the user of the bottle does not have to rotate the stopper for several turns to unseal the bottle.

According to an eighth embodiment of the invention, in the third to seventh embodiments, the screw threads are broken longitudinally by one or more, preferably two surfaces, which are preferably plain. A stopper according to the eighth embodiment of the invention provides the additional advantage that any parting lines caused by the manufacturing process can be accommodated on the (plain) surfaces and therefore are not on the screw threads causing undesired friction.

According to an ninth embodiment of the invention, in one of the preceding embodiments, the stopper part is configured so that the sealing element, after being brought into the unsealed position, is retained on the stopper part of the stopper upon pulling the stopper out of the mouth. A closure system consisting of a sealing and a stopper according to the ninth embodiment of the invention forms a unit even after opening the bottle, contrary e.g. to the closure system disclosed in U.S. Pat. No. 3,245,569, which is split in two parts after the user has opened the bottle. The closure system according to this embodiment of the present invention is easier to use by the consumer.

According to a tenth embodiment of the invention, in one of the preceding embodiments, the sealing element is retained by a portion of the stopper part which has a diameter that is larger than a diameter of the portion above it.

According to a eleventh embodiment of the invention, in the tenth embodiment, the stopper part further comprises a first portion and a second portion along the longitudinal axis of the stopper, wherein the second portion has a diameter that is larger than a diameter of the first portion. The second portion allows for retaining the sealing element on the stopper part of the stopper after the user has brought the sealing element into the unsealed position and pulls the stopper out of the mouth of the bottle. The sealing element is maintained in place on the stopper part thanks to the larger diameter of the second portion of the stopper, so that the stopper can be removed by the user together with the sealing element on the stopper part.

According to a twelfth embodiment of the invention, in the eleventh embodiment, the difference in diameter at any two cross sectional points on the stopper part is not more than 30%.

According to a thirteenth embodiment of the invention, in the eleventh embodiment, diameter of the first portion of the stopper part is not less than 70% of the diameter of the second portion of the stopper part.

According to a fourteenth embodiment of the invention, in the eleventh or twelfth embodiment, the diameter of the first portion of the stopper part is not less than 60% of the diameter of the screw threads on the stopper part.

The above configuration of the stopper ensures that the stopper part is not too thin on any part compared to the other parts of the stopper, thereby providing higher strength to the stopper and avoiding easy breaking of the stopper, especially when made from brittle materials such as glass. Furthermore, having small changes in the shape of the stopper allows for simpler molding and manufacturing process which results in a faster, better quality and more cost efficient stopper.

According to a fifteenth embodiment of the invention, in the eleventh embodiment, the first portion has an essentially cylindrical shape along the longitudinal axis of the stopper.

According to a sixteenth embodiment of the invention, in one of the preceding embodiments, one or more channels are formed on the surface of the stopper part, the channels extending parallel to the longitudinal axis of the stopper from a tip of the stopper. In a bottle comprising a sparkling beverage, preferably a sparkling wine, this allows for easily releasing the inner pressure within the bottle when opening it.

According to a seventeenth embodiment of the invention, in the sixteenth embodiment, the number of channels is preferably four.

According to an eighteenth embodiment of the invention, in the sixteenth or seventeenth embodiment, the channels are equidistant from each other. This ensures uniform and regulated releasing of inner pressure.

According to a nineteenth embodiment of the invention, in one of the preceding embodiments, the head part comprises at least one pair of notches that are formed on a lateral surface of the head part at diametrically opposed positions. This allows for simplifying the opening process for the user, as the notches can be used for a better grip of the user's fingers on the head part of the stopper, thereby rendering rotating the head part of the stopper easier.

According to a twentieth embodiment of the invention, in one of the preceding embodiments, the head part has a circular or polygonal cross section when viewed from the top. The advantage of providing a polygonal cross section is that it is easy for gripping.

According to a twenty first embodiment of the invention, in one of the preceding embodiments, the sealing element comprises a sealing part pressed against an inner wall of the mouth, upon introducing the stopper part into the mouth. The sealing element provides for the sealing between the stopper and the glass bottle.

According to a twenty second embodiment of the invention, in the twenty first embodiment, the sealing element further comprises an upper part joining the sealing part via a neck portion of the sealing part of the sealing element, the upper part being adapted to seal the head part of the stopper against the top surface of the mouth in the sealed position. The advantage of providing the upper part of the sealing element is that it provides sealing between the head of the stopper and the mouth of the bottle, thereby avoiding breaking of the stopper and glass bottle during forced pressing.

According to a twenty third embodiment of the invention, in the twenty second embodiment, the upper surface of the upper part of the sealing element comprises means for reducing the rotational friction between the head part of the stopper and the upper surface of the upper part of the sealing element. A higher frictional force in the radial direction between the head part and the sealing element when compared to the frictional force between the sealing element and the glass bottle may result in rotating the sealing element with the stopper, thereby causing spinning of the sealing element in the bottle. Such spinning of the sealing element makes it difficult to open the bottle by rotation. The means for reducing the friction solves the problem of spinning.

According to a twenty fourth embodiment of the invention, in the twenty third embodiment, the means for reducing the rotational friction between the head part of the stopper and the upper surface of the upper part of the sealing element comprises at least one rim.

According to a twenty fifth embodiment of the invention, in the twenty fourth embodiment, the rim is formed as a continuous circle. A rim formed as a continuous circle reduces the area of contact between the head part and the surface of the sealing element, and thereby reduces the rotational friction between the head part of the stopper and the upper part of the sealing element.

According to a twenty sixth embodiment of the invention, in the twenty first or twenty second embodiments, elements are formed on the outer side of the sealing part which are adapted to be pressed against the inner wall of the mouth in the sealed position, and to build up an under-pressure or suction force in one or more areas between the sealing part and the inner wall of the mouth when the sealing element is brought into the sealed position. This enables a particularly secure and reliable adherence of the sealing part on the inner wall of the bottle, thereby ensuring a particularly secure and reliable sealing of the sealing element. It also facilitates that the sealing part is firmly held in place when the stopper is rotated relative to the sealing element during the unsealing action.

According to a twenty seventh embodiment of the invention, in the twenty sixth embodiment, the elements formed on the outer side of the sealing part have the shape of adjacent ribs.

According to a twenty eighth embodiment of the invention, in the twenty sixth or twenty seventh embodiments, the elements formed on the outer side of the sealing part have the shape of ribs with a substantially saw tooth cross section. These saw tooth cross section ribs provide a smaller diameter of entry onto the glass bottle, thereby allowing easier insertion of the sealing element into the bottle and resistance against pulling the sealing element out of the mouth of the bottle.

According to a twenty ninth embodiment of the invention, in one of the twenty first to twenty eighth embodiments, the sealing part is made of a flexible material enabling a deformation of the sealing part when the sealing element is brought into the sealed position.

According to a thirtieth embodiment of the invention, in the twenty ninth embodiment, the sealing part is made of a material having a shape memory. This allows for bringing the stopper into a sealed position of the stopper in the bottle while guaranteeing an easy return of the sealing part to a state of rest in the unsealed position.

According to a thirty first embodiment of the invention, in one of the twenty first to thirtieth embodiments, in the sealed position, the entire sealing part is located at the height of the upper 60% of the stopper part.

According to a thirty second embodiment of the invention, in the thirty first embodiment, in the sealed position, the entire sealing part is located at the height of the upper 50% of the stopper part.

According to a thirty third embodiment of the invention, in the thirty first embodiment, in the sealed position, the entire sealing part is located at the height of the upper 30% of the stopper part.

Providing the sealing part on the upper end of the stopper in the sealed position according to the thirty first to thirty third embodiments allows for easier bottling and insertion into the bottle. This is because since the sealing part is on the upper end of the stopper part in a sealed position, it comes in contact with the mouth of the bottle only at the last instance as compared to providing a sealing part throughout the stopper part or on the lower end of the stopper part. This allows a faster bottling process compared to other design of closure systems such as in GB 1 276 485, where the increased thickness of the sleeve is in the lower end.

According to a thirty fourth embodiment of the invention, in one of the preceding embodiments, an inner surface of the sealing element has a smaller friction coefficient than an outer surface of the sealing element. This allows for the sealing element to be securely sealed to the inner wall of the bottle and further enables a smooth interaction with the stopper, without spinning of the sealing element during the unsealing action.

According to a thirty fifth embodiment of the invention, in one of the preceding embodiments, the stopper part comprises a means for pressing the sealing element on a neck portion of the stopper part, via which neck portion the head part joins the stopper part. The "neck portion" is defined further down in this specification. It has to be noted that location of the means for pressing on the neck portion of the stopper part does not mean that the area where the means for pressing are located must start directly underneath the head part. There can be some space between the head part and the start of this area, e.g. 5 millimeters. For instance, such space allows taking into account that it is difficult to exercise pressure in the area of the curvature of the top surface of the mouth of the bottle.

According to a thirty sixth embodiment of the invention, in the thirty fifth embodiment, at least a part of the interlocking mechanism is arranged on at least a part of the means for pressing the sealing element.

According to a thirty seventh embodiment of the invention, in the thirty sixth embodiment, at least a lower portion of the means for pressing the sealing element, or a portion of the stopper part below the means for pressing the sealing element, has a diameter decreasing along the longitudinal axis away from the head part of the stopper. This makes it easier to bring the sealing element into the sealed position upon introducing the stopper part into the mouth of the bottle.

According to a thirty eighth embodiment of the invention, in the thirty seventh embodiment, at least a part of the interlocking mechanism is arranged on at least a part of the portion with decreasing diameter. This allows building up pressure slowly when the stopper is screwed into sealing element on the bottle.

According to a thirty ninth embodiment of the invention, in the thirty seventh or thirty eighth embodiments, the portion with decreasing diameter has an essentially conical shape along the longitudinal axis of the stopper.

According to a sixtieth embodiment of the invention, in one of the thirty seventh to thirty ninth embodiments, the stopper part comprises a third portion and a fourth portion, the third portion being comprised by the means for pressing the sealing element and having an essentially cylindrical shape along the longitudinal axis of the stopper, and being arranged above the fourth portion, which is the portion with decreasing diameter. The third portion has a larger diameter across an essentially cylindrical section, which makes it particularly suitable for bringing the sealing element into the sealed position upon introducing the stopper part into the mouth of the bottle.

According to a forty first embodiment of the invention, in one of the preceding embodiments, the sealing element comprises an essentially cylindrically shaped ring.

According to a forty second embodiment of the invention, in one of the preceding embodiments, the sealing element has an opening on the bottom of the sealing element with a diameter which is essentially identical to a diameter of an opening on the top of the sealing element.

According to a forty third embodiment of the invention, in one of the preceding embodiments, a diameter of the opening on the bottom of the sealing element varies from a diameter of the opening on the top of the sealing element by at most 20%.

The essentially cylindrically shaped ring with the circular opening allows the stopper part of the stopper to pass through it, thereby holding the tamper proof element securely on the sealing element in horizontal direction.

According to a forty fourth embodiment of the invention, in one of the preceding embodiments, the length of the sealing element is not greater than essentially half of the length of the stopper part.

According to a forty fifth embodiment of the invention, in the forty fourth embodiment, the length of the sealing element is not greater 60% of the length of the stopper part.

According to a forty sixth embodiment of the invention, in one of the preceding embodiments, the length of the sealing element is not greater than essentially an outside diameter of the sealing element.

According to a forty seventh embodiment of the invention, in the forty sixth embodiment, the length of the sealing element is not greater 120% of an outside diameter of the sealing element.

The features of the forty fourth to forty seventh embodiments relate to the dimensions of the sealing element in relation to the size of the stopper. It is advantageous to provide a sealing element in a size which is relatively smaller than the stopper part. For example, in the bottling process, it is easier to introduce a stopper having a relatively smaller length sealing element rather than a stopper having a longer length sealing element, since the force required to be exerted in order to seal the bottle can be applied for a relatively smaller time, thereby ensuring a faster bottling process.

According to a forty eighth embodiment of the invention, in one of first to thirty fourth embodiments, the sealing element comprises at least a first component and a second component. The advantage of providing different components is that each component can comply with different specifications. It is possible to have different components specifically designed to perform different functions, thereby overcoming limitations of many single component sealing elements. For example, the two components can be made of different materials having different frictional coefficients. Furthermore, the components can be designed to interface with the different parts of the stopper or mouth of the bottle as required.

According to a forty ninth embodiment of the invention, in the forty eighth embodiment, the first component of the sealing element comprises the counterpart interlocking mechanism adapted to engage with the interlocking mechanism on the stopper. This enables the sealing element to be interlocked with the stopper part of the stopper According to a fiftieth embodiment of the invention, in one of the forty eighth or forty ninth embodiments, the first component of the sealing element consists of or comprises a plastic material.

According to a fifty first embodiment of the invention, in one of the forty eighth to seventieth embodiments, a lower portion of the first component comprises an assembly grip to enable assembling of the sealing element onto the stopper by screwing. This allows for a screwing tool to engage with the assembly grips, and therefore for easier assembly of the stopper and sealing element.

According to a fifty second embodiment of the invention, in one of the forty eighth to seventieth embodiments, the second component of the sealing element is more flexible and/or elastic than the first component of the sealing element. This ensures that the second component can be compressed during the sealing action, whereas the first component remains in its original shape.

According to a fifty third embodiment of the invention, in one of the forty eighth to fifty second embodiments, the length of the second component is not greater than essentially half of the length of the stopper part.

According to a fifty fourth embodiment of the invention, in the fifty third embodiment, the length of the second component is not greater than 60% of the length of the stopper part.

The features of the fifty third and fifty fourth embodiments describe the size of the second component in relation with the size of the stopper. It is advantageous to provide a second component having the sealing part in a size which is relatively smaller than the stopper part for the reasons described above.

According to a fifty fifth embodiment of the invention, in one of forty eighth to fifty second embodiments, when in the twenty fourth embodiment, the second component comprises the sealing part.

According to a fifty sixth embodiment of the invention, in one of the forty eighth to fifty fifth embodiments, the second component comprises an essentially cylindrically shaped ring.

According to a fifty seventh embodiment of the invention, in the fifty sixth embodiment, the second component has an opening on the bottom of the second component with a diameter which is essentially identical to a diameter of an opening on the top of the second component.

According to a fifty eighth embodiment of the invention, in the fifty seventh embodiment, a diameter of the opening on the bottom of the second component varies from a diameter of the opening on the top of the second component by at most 20%.

The essentially cylindrically shaped ring with the circular openings provided on each end of the sealing element allows that the inner component of the sealing element and the stopper part of the stopper can pass through them. According to a fifty ninth embodiment of the invention, in the fifty eighth embodiment, the length of the second component is not greater than essentially half of the length of the stopper part.

According to a sixtieth embodiment of the invention, in the fifty ninth embodiment, the length of the second component is not greater 60% of the length of the stopper part.

According to a sixty first embodiment of the invention, in one of the preceding embodiments, the length of the sealing element is not greater than essentially an outside diameter of the sealing element.

According to a sixty second embodiment of the invention, in the sixty first embodiment, the length of the sealing element is not greater 120% of an outside diameter of the sealing element.

The features of the fifty ninth to sixty second embodiments relate to the dimensions of the sealing element which contribute to the design of the overall size of the second component in relation with the size of the stopper. It is advantageous to provide second component having the sealing part in a size which is relatively smaller than the stopper part, for the reasons described above.

According to a sixty third embodiment of the invention, in one of the forty eighth to fifty fifth embodiments, the first component of the sealing element comprises a spreading element configured to be located at least partially in between the stopper part and the second component of the sealing element in the sealed position. This spreading element on the first component pushes the sealing part outwardly, and when inside a bottle, the sealing part is moved towards the inner surfaces of the bottle neck to enable sealing.

According to a sixty fourth embodiment of the invention, in the sixty third embodiment, the spreading element has an outer diameter increasing along the longitudinal axis. This enables easier insertion of the first component into the second component.

According to a sixty fifth embodiment of the invention, in one of the sixty third or sixty fourth embodiments, the spreading element is an essentially cylindrically shaped ring.

According to a sixty sixth embodiment of the invention, in one of the sixty third to sixty fifth embodiments, the spreading element has a conical shape.

According to a sixty seventh embodiment of the invention, in one of the sixty third to sixty sixth embodiments, when depending from the fifty sixth embodiment, the essentially cylindrically shaped ring has an inner diameter increasing along the longitudinal axis.

The outer component also has a conical inner diameter in order to accommodate the conically shaped spreading element. This provides a uniform spreading of the outer component by the spreading element against the mouth of the bottle and it also facilitates entering of the spreading element into the outer component.

According to a sixty eighth embodiment of the invention, in one of the sixty third to sixty seventh embodiments, the second component of the sealing element contains a sealing region on its inner side configured to provide sealing between the stopper and the second component of the sealing element. This lip provides for additional sealing between the stopper and the sealing element.

According to a sixty ninth embodiment of the invention, in the sixty eighth embodiment, the sealing region is located on the upper side of the second component of the sealing element.

According to a seventieth embodiment of the invention, in one of the sixty eighth or sixty ninth embodiments, the sealing region provides the sealing between a neck portion of the stopper and the second component of the sealing element.

According to a seventy first embodiment of the invention, in one of the sixty eighth to ninetieth embodiments, the sealing region comprises one or more lips or ribs.

The sealing region on the upper side of the inner surface of the second component provides sealing between the stopper and the sealing part. This ensures that there is airtight sealing between the stopper and the sealing element. Such an airtight sealing would be difficult to achieve between the first component and the stopper.

According to a seventy second embodiment of the invention, in one of the sixty third to seventy first embodiments, the lower end of the first component of the sealing element is tapered. The tapered lower end allows easy introduction of an assembled system into the mouth of the bottle According to a seventy third embodiment of the invention, in one of the sixty third to sixty seventh embodiments, the interlocking mechanisms are configured to permit moving the head part of the stopper relatively away from the first component of the sealing element when rotating the stopper during the unsealing action. This creates a space between the head part of the stopper and the top of the mouth of the bottle, which allows for the first component of the sealing element to be pushed deeper into the mouth of the bottle, along with the stopper, when the stopper after unscrewing is pushed back into the mouth of the bottle, during the unsealing action.

According to a seventy fourth embodiment of the invention, in the seventy third embodiment, rotating the stopper during the unsealing action reduces the frictional or adhesive force between the sealing element and the inner wall of the mouth. This facilitates the unsealing action.

According to a seventy fifth embodiment of the invention, in one of the seventy third or seventy fourth embodiments, moving the first component of the sealing element relatively away from the second component of the sealing element during the unsealing action reduces the frictional or adhesive force between the sealing element and the inner wall of the mouth. This enables partial release of pressure to facilitate the unsealing action.

According to a seventy sixth embodiment of the invention, in the seventy fifth embodiment, the interlocking mechanisms are configured to permit the stopper to move the first component of the sealing element away from the second component of the sealing element when the stopper is pushed into the mouth. By pushing the stopper into the mouth of the bottle after unscrewing, the first component is pushed away from the second component, thereby releasing the pressure to facilitate unsealing.

According to a seventy seventh embodiment of the invention, in any of the seventy third to seventy sixth embodiments, moving the sealing element further into the mouth of the bottle during the unsealing action reduces the frictional or adhesive force between the sealing element and the inner wall of the mouth.

According to a seventy eighth embodiment of the invention, in the seventy seventh embodiment, the interlocking mechanisms are configured to permit the stopper to move the sealing element further into the mouth of the bottle when the stopper is pushed into the mouth.

According to a seventy ninth embodiment of the invention, in any of the sixty third to seventy eighth embodiments, the stopper is adapted to be used for a resealing action comprising moving the head part of the stopper relatively towards the first component of the sealing element.

According to a eightieth embodiment of the invention, in the seventy ninth embodiment, the first component of the sealing element is configured to move, when moving relatively towards the head part of the stopper, along the stopper part and further inside the second component of the sealing element to bring the sealing element into a resealed position.

According to a eighty first embodiment of the invention, in any of the seventy ninth or eightieth embodiments, the lower portion of the first component contains a spring configured to push the first component to facilitate engagement of the threading means.

An eighty second embodiment of the invention provides a stopper comprising a stopper part for introduction into a mouth of the bottle, and a head part for remaining outside the mouth, the head part having a diameter that is larger than that of the stopper part, where a longitudinal cavity is formed within the stopper, the longitudinal cavity extending along the longitudinal axis of the stopper and opening out at the top end of the longitudinal cavity and at the tip of the stopper, where a filter cavity with a diameter larger than the diameter of the longitudinal cavity is formed at the opening out at the top end of the longitudinal cavity.

The filter cavity is in order to accommodate a filter and maturity measurement for controlling and testing the oxidation of wine in the bottle. This allows for providing means in the stopper, for controlling and testing the oxidation of wine in the bottle. Providing the filter cavity at the opening out at the top end of the longitudinal cavity allows for easy access to the filter.

According to the eighty fourth embodiment of the invention, in one of eighty second or eighty third embodiment, at a given cross-section, the diameter of the longitudinal cavity (417*b*) is not greater than 30% of the diameter of the stopper part. This is in order to provide only a small opening for air to reach the filter and maturity measurement. Too large an opening might provide too much air and also weaken the stopper due to the hollow cavity.

According to the eighty-fifth embodiment, in one of eighty-second to eighty fourth embodiments the stopper is a stopper according to one of first to one hundred and first embodiments.

An eighty sixth embodiment of the invention provides a stopper comprising a stopper part for introduction into a mouth of the bottle, and a head part for remaining outside the mouth, the head part having a diameter that is larger than that of the stopper part, where a storage cavity is formed in the head part of the stopper.

Thanks to the bottle closure system according to an embodiment of the present invention, secure sealing of the stopper in the bottle can be achieved without requiring the stopper to be made as a solid core element like in the systems according to the prior art. This allows for manufacturing a stopper with a cavity, which in turn allows for dramatically reducing the amount of material necessary for the stopper compared to the systems according to the prior art. This cavity can be used to include information literature or the like on the head part of the stopper.

According to the eighty seventh embodiment, in the in the eighty sixth embodiment, the storage cavity has a depth such that for a given cross-section of the cavity, the volume of the cavity is maximized.

According to the eighty eighth embodiment, in one of eighty sixth or eighty seventh embodiment, a depth of the storage cavity is at least 50% of the height of the head part.

According to the eighty ninth embodiment, in one of one of eighty sixth to eighty eighth embodiments, a depth of the storage cavity is at least 60% of the height of the head part According to the ninetieth embodiment, in one of eighty-sixth to eighty-ninth embodiment a depth of the storage cavity is at least 70% of the height of the head part This depth is selected such that there is a decent balance between providing the storage cavity with maximized storage volume, as well as avoiding making the corners on the head part unstable due to the lesser volume of material on the stopper due to the deeper cavity According to the ninety-first embodiment in the eighty-sixth embodiment the cavity formed on the head part of the stopper has a polygonal cross section when viewed from the top.

According to the ninety-second embodiment in the ninety-first embodiment, the cavity formed on the head part of the stopper has a rectangular cross section when viewed from the top.

According to the ninety-third embodiment, in the ninety-second embodiment the cavity formed on the head part of the stopper has a quadratic cross section when viewed from the top.

The advantage of providing a rectangular and in particular a square cross sectional cavity is that it efficiently utilizes the space for storing a folded piece of literature, and also provides sufficient non-cavity area on the surface of the head part for an adhesive for a disk, muselet or the like that covers the cavity.

According to the ninety-fourth embodiment, in one of eighty-sixth to ninety-third embodiments, the length of a diagonal of the cross section of the storage cavity when viewed from the top is at least 70% of a diagonal of the upper surface of the head part.

According to the ninety-fifth embodiment, in one of eighty-sixth to ninety-fourth embodiments, the storage cavity is large enough to accommodate an object having a height of 5 mm, a length of 10 mm, and a width of 10 mm.

According to ninety-sixth embodiment in the ninety-fifth embodiment the storage cavity is large enough to accommodate an object having a height of 7 mm, a length of 15 mm, and a width of 15 mm.

These lengths of the diagonal cross section of the storage cavity according to the thirty second to thirty fourth embodiments are selected such that there is a decent balance between providing the storage cavity with maximized storage volume, as well as avoiding making the lateral corners on the head part unstable due to the lesser volume of material on the stopper due to a wider cavity.

According to the ninety-seventh embodiment, in any one of preceding embodiments a cover is provided for covering the storage cavity and/or filter cavity. The cover is used to cover the storage or filter cavity in order to hold the materials placed inside the cavity.

According to the ninety eight embodiment, in the ninety seventh embodiment, the cover is accommodated by a recess on the top surface of the head part. This recess facilitates alignment of the cover, and also provides a flush finish on the upper surface of the head part when the cover is placed.

According to the ninety ninth embodiment, in one of ninety seventh or ninety eight embodiments, the cover is fixed to the top surface of the head part by an adhesive. This facilitates assembly of the system and it also ensures that the objects in the cavity are held safely.

In the one hundredth embodiment, in one of eighty sixth to ninety ninth embodiments, where the stopper is a stopper according to one of first to eighty fourth embodiments.

In the one hundredth first embodiments, in one of the preceding embodiments, the stopper is made of a material chosen out of the group consisting of glass, ceramic, plastic, metal and wood, and other hardened materials.

A one hundred second embodiment of the invention provides a sealing element for sealing a stopper for a bottle designed for commercial bottling of a beverage or liquid food, preferably a wine bottle, the sealing element being separate from the bottle and comprising a sealing part for sealing the stopper against an inner wall of a mouth of the bottle in a sealed position, the sealing part of the sealing element is configured to be pressed against an inner wall of the mouth, the sealing part of the sealing element being thereby configured to be brought into the sealed position upon introducing the stopper part of the stopper into the mouth, in which sealed position the stopper is held on the bottle by way of a frictional connection, the sealing element comprises a counterpart interlocking mechanism that is adapted to engage with an interlocking mechanism of the stopper part, the interlocking mechanisms being configured to permit bringing the sealing element into an unsealed position by an unsealing action which comprises rotating the stopper with respect to the bottle. The sealing element according to this embodiment provides a more secure and reliable sealing than the sealing provided with convention sealing element used with the stopper according to the prior art can be achieved.

According to a one hundred third embodiment of the invention, in the one hundred second embodiment, the sealing element further comprises the features of the sealing element described in one of the third to one hundred first embodiments.

A one hundred fourth embodiment of the invention provides a system comprising a stopper according to any of the first to one hundred first embodiments of the invention and a sealing element according to any one of the one hundred second or one hundred third embodiment of the invention.

According to a one hundred fifth embodiment of the invention, in the one hundred fourth embodiment, when the system is fully assembled, the stopper and the sealing element are in the same configuration in relation to each other as in the sealed position. It is possible to assemble the closure system into a fully assembled state outside the bottle. This allows assembly and bottling to take place in different locations.

According to a one hundred sixth embodiment of the invention, in the one hundred fifth embodiment, the system is configured such that the system when fully assembled can be pushed into the mouth of the bottle, thereby bringing the sealing element into the sealed position. The fully assembled closure system according to this invention can be simply pushed into the bottle to bring it into a sealed position in the bottling process without requiring any further action. This allows for faster and simpler bottling, and also reducing the cost of bottling machinery.

According to a one hundred seventh embodiment of the invention, in one of the one hundred fourth to one hundred sixth embodiments, the system when fully assembled has an overall conical shape. The fully assembled closure system according to this invention has a conical shape to allow easy introduction of the assembled system into the bottle, thereby allowing easy bottling.

According to a one hundred eighth embodiment of the invention, in one of the one hundred fourth to one hundred seventh embodiments, the system furthermore comprising a tamper proof element which allows the user to find out whether the stopper, after the system has been fully assembled, has been moved with respect to the sealing element in radial and/or axial direction. The tamper proof element allows the user to find out if the bottle has already been opened.

According to a one hundred ninth embodiment of the invention, in the one hundred eighth embodiment, the tamper proof element is connected to the stopper and to the sealing element on such that when the stopper is moved with respect to the sealing element in radial and/or axial direction, the tamper proof element is broken. Any axial or radial movement which occurs in a bottled state breaks the tamper proof element which signifies that the bottle has been opened or tampered with.

According to a one hundred tenth embodiment of the invention, in the one hundred ninth embodiment, the connection between the tamper proof element and the stopper is an interlocking connection, a frictional connection or an adhesive connection in radial and/or axial direction. According to a one hundred eleventh embodiment of the invention, in one of the one hundred ninth or one hundred tenth embodiments, the connection between the tamper proof element and the sealing element is an interlocking connection, a frictional connection or an adhesive connection in radial and/or axial direction.

According to a one hundred twelfth embodiment of the invention, in one of the one hundred eighth to one hundred eleventh embodiments, the tamper proof element comprises a ring.

According to a one hundred thirteenth embodiment of the invention, in the one hundred twelfth embodiment, an inner diameter of the ring is essentially identical to an outer diameter of the sealing element and/or an outer diameter of the ring is not greater than the outer diameter of the head part of the stopper.

According to a one hundred fourteenth embodiment of the invention, in one of the one hundred twelfth or one hundred thirteenth embodiments, the sealing element comprises the features described in twenty second embodiment, and wherein when the system is fully assembled, the ring is located on the stopper part of the stopper, below the upper part of the sealing element.

The ring of the tamperproof element has a diameter such that is it is possible for the sealing part of the sealing element to penetrate the ring, and at the same time the ring stays underneath the head part of the stopper. Arrangement of the tamper proof element as described above forms an interlocking connection in the axial direction, and a frictional connection in the radial direction in between the sealing element and the tamper proof element.

According to a one hundred fifteenth embodiment of the invention, in one of the one hundred eighth to one hundred fourteenth embodiments, the tamper proof element comprises one or more, preferably two strips which when the system is fully assembled are connected to head part of the stopper.

According to a one hundred sixteenth embodiment of the invention, in the one hundred fifteenth embodiment, when the system is fully assembled, the strips are wrapped around the lateral surfaces and at least parts of the upper surface of the head part of the stopper.

In this way, an interlocking connection in the axial direction, and a frictional connection in the radial direction is formed between the tamper proof element and the head part of the stopper.

According to a one hundred seventeenth embodiment of the invention, in the one hundred sixteenth embodiment, one or more strips are accommodated within notches on the lateral surfaces of the head part of the stopper. In addition to the frictional connection in the radial direction, the notches on the lateral surface provide an interlocking mechanism in the radial direction. In a preferred embodiment, two notches are provided on opposite sides of the head part of the stopper.

According to a one hundred eighteenth embodiment of the invention, in one of the one hundred sixteenth or one hundred seventeenth embodiments, when the system is fully assembled, the ends of strips meeting on the upper surface or lateral surfaces of the head part of the stopper are joined together, preferably by an adhesive. This provides for an interlocking connection between the tamper proof element and the head part of the stopper.

According to a one hundred nineteenth embodiment of the invention, in the one hundred sixteenth embodiment, the stopper is a stopper in accordance with the thirty fifth embodiment, and wherein when the system is fully assembled, strips connected to the cover, preferably by an adhesive. An adhesive cover above the strips provide for an additional adhesive connection to the tamper proof element. Furthermore, the cover covers the strips thereby providing a nicer looking upper surface.

According to a one hundred twentieth embodiment of the invention, in one of the one hundred eighteenth or one hundred nineteenth embodiments, when depending from the one hundred twelfth embodiment, wherein the strips are connected to and extend from the ring.

According to a one hundred twenty first embodiment of the invention, in one of the one hundred eighth to one hundred twentieth embodiments, the tamper proof element comprises or consists a material chosen out of the group consisting of plastic, aluminium, or laminated aluminium. The material is selected for the tamper proof element such that it is soft enough to be broken easily when opening, but hard enough to withstand normal wear and tear during transportation.

A one hundred twenty second embodiment of the invention provides a bottle designed for commercial bottling of a beverage or liquid food, preferably a wine bottle, being sealed with a system according to one of the one hundred fourth to one hundred twenty first embodiments.

A one hundred twenty third embodiment of the invention provides a method of assembling the system according to one of the one hundred fourth to one hundred seventh embodiments comprising the step of introducing a sealing element according to one of the one hundred second or one hundred third embodiments onto the stopper part of a stopper according to one of the first to one hundred first embodiments.

According to a one hundred twenty fourth embodiment of the invention, in the one hundred twenty third embodiment, the stopper is a stopper according to one of forty eighth to one hundred first embodiment, and introducing the sealing element onto the stopper further comprises the steps of introducing the first component of the sealing element into the second component of the sealing element and screwing the sealing element onto the stopper part of the stopper.

According to a one hundred twenty fifth embodiment of the invention, in the one hundred twenty fourth embodiment, the stopper is a stopper according to fifty first embodiment, and the screwing of the sealing element onto the stopper is performed by using the assembly grip.

According to a one hundred twenty sixth embodiment of the invention, in one of the one hundred twenty third to one hundred twenty fifth embodiments, the method further comprising the step of, after introducing the sealing element onto the stopper part of the stopper, introducing a tamper proof element comprising the features described in one of the one hundred twelfth, one hundred thirteenth, or one hundred eighteenth embodiments onto the stopper part of a stopper.

The method of assembling, which includes introducing the first and second components, screwing them onto the stopper and also introducing tamperproof element until a fully assembled system is achieved, all can be performed outside the bottle. Therefore, assembly can be performed separately before bottling.

A one hundred twenty seventh embodiment of the invention provides a method of sealing a bottle designed for commercial bottling of a beverage or liquid food, preferably a wine bottle, with a system according to one of the one hundred fourth to one hundred seventh embodiments, the method comprising the step of pressing the fully assembled system into the mouth of the bottle until the sealed position is reached.

According to a one hundred twenty eighth embodiment of the invention, in the one hundred twenty seventh embodiment, the sealed position is reached without rotating the stopper.

According to a one hundred twenty ninth embodiment, in one of the one hundred twenty seventh or one hundred twenty eighth embodiments, the method further comprising the step of, prior to pressing the fully assembled system into the mouth of the bottle, fully assembling the system in accordance with the method of one of the one hundred twenty third to one hundred twenty sixth embodiments.

The fully assembled closure system with the tamper proof element can be bottled just by pressing and does not require rotating the stopper into the mouth of the bottle to achieve a sealed position. Since it does not require any complex method steps for bottling, it does not require complex and expensive bottling machinery, thereby reducing the overall cost.

A one hundred and thirtieth embodiment of the invention provides a bottle designed for commercial bottling of a beverage or liquid food, preferably a wine bottle, comprising a continuous or broken ridge formed along the perimeter of the top surface of the mouth of the bottle such that the ridge forms a continuous or broken circle, wherein the ridge is spaced away from the inner circumference of the mouth of the bottle.

The bottle of this embodiment when used in a system as it will be described below provides an advantage such that the ridge on the bottle covers a gap which may be formed by the thickness of the sealing element, thereby avoiding accumulation of dust or dirt on the sealing element through the gap formed between them.

According to the one hundred and thirty first embodiment of the invention, in the one hundred and thirtieth embodiment, the top surface of the mouth of the bottle is substantially plain.

This substantially plain surface ensures that in a sealed position, the sealing element is well placed on the top surface of the mouth of the bottle.

According to the one hundred and thirty-second embodiment, in one of the one hundred and thirtieth or one hundred and thirty-first embodiments, the ridge is formed near or on the outer circumference of the top surface of the mouth of the bottle. Providing the ridge near or on the outer circumference ensures that the depth of the gap between the stopper and the bottle is reduced to the minimum.

According to the one hundred and thirty-third embodiment, in the one hundred and thirty-second embodiment, the outer side of the ridge is flush with the outer side of the neck of the bottle.

According to a one hundred and thirty-fourth embodiment, in one of the one hundred and thirtieth to the one hundred and thirty-third embodiments, the ridge is broken at one or more positions along the perimeter of the top surface of the mouth of the bottle. The bottle of this embodiment when used in a system having a tamper proof element, as it will be described below, provides an advantage such that at these positions, strips of a tamper proof element can be accommodated. In this embodiment, the ridge provides the additional advantage of improving the tamper proof mechanism.

According to a one hundred and thirty-fifth embodiment, in one of one hundred and thirty thirtieth to one hundred and thirty-fourth embodiments, the ridge is broken at two diagonally opposite sides on the perimeter of the top surface of the mouth of the bottle.

According to a one hundred and thirty-sixth embodiment, in one of the one hundred and thirtieth to one hundred thirty-fifth embodiments, the height of the ridge is 2.0 mm or less.

According to a one hundred and thirty-seventh embodiment, in the one hundred and thirty-sixth embodiment, the height of the ridge is 1.5 mm or less.

According to a one hundred and thirty-eighth embodiment, in the one hundred and thirty-seventh embodiment, the height of the ridge is 1.0 mm or less.

According to a one hundred and thirty-ninth embodiment, in one of the one hundred and thirtieth to one hundred and thirteen ninth embodiments, the height of the ridge is 1.0 mm or more.

According to a one hundred and fortieth embodiment, in one of the one hundred and thirtieth to one hundred and thirty-sixth embodiments, the height of the ridge is 1.5 mm or more.

The different heights of the ridges are selected in accordance with the thickness of the sealing element such that there is a balance between providing a ridge being too high and thus being in contact with the stopper, and a ridge being too small and thus providing too large a gap between the stopper and the mouth of the bottle.

According to a one hundred and forty-first embodiment, in one of the one hundred and thirtieth to the one hundred and fortieth embodiments, the cross section of the ridge is substantially triangular or rectangular shaped. This cross section is selected such that the sealing element is properly placed within the ridge.

According to the one hundred and forty-second embodiment, in one of the one hundred and thirtieth to one hundred and forty-first embodiments, the distance between the ridge and the inner circumference of the mouth of the bottle is at least 1.5 mm.

According to a one hundred and forty-third embodiment, in the one hundred and forty-second embodiment, the distance between the ridge and the inner circumference of the mouth of the bottle is at least 2.0 mm.

According to the one hundred and forty-fourth embodiment, in the one hundred and forty-third embodiment, the distance between the ridge and the inner circumference of the mouth of the bottle is at least 2.5 mm.

The distance between the ridge and the inner circumference of the mouth of the bottle is selected such that, when used in the system having a sealing element, the ridge can accommodate the sealing element within the circumference of the ridge and avoid overlaps.

A one hundred and forty-fifth embodiment of the invention provides a system comprising a bottle according to the one hundred and thirtieth embodiment, a stopper comprising a stopper part for introduction into a mouth of the bottle, and a head part for remaining outside the mouth, the head part having a diameter that is larger than that of the stopper part and sealed with a sealing element between them, and a sealing element comprising a part adapted for sealing the head part of the stopper against the top surface of the mouth.

In the system having a stopper having a head part and a stopper part, and a sealing element, the gap formed between the head part of the stopper and the top surface of the bottle caused by the sealing element is covered by a ridge formed on the top surface of the mouth of the bottle. This system therefore stops the accumulation of dust or dirt on the sealing element on the gap formed between them.

According to a one hundred and forty-sixth embodiment, in the one hundred and forty-fifth embodiment, the height of the ridge formed along the perimeter of the top surface of the mouth of the bottle is less than the thickness of the part of the sealing element adapted for sealing the head part of the stopper against the top surface of the mouth.

The height of the ridge is selected in accordance with the thickness of the sealing element such that there is a balance between providing a ridge not being too high and not being in contact with the stopper, and a ridge not being too small and not providing too large a gap between the stopper and the mouth of the bottle.

According to a one hundred and forty-seventh embodiment, in the one hundred and forty-fifth embodiment, the outer diameter of the part of the sealing element adapted for sealing the head part of the stopper against the top surface of the mouth is less than the inner diameter of the ridge formed along the perimeter of the top surface of the mouth of the bottle.

The distance between the ridge and the inner circumference of the mouth of the bottle is selected such that, when used in the system having a sealing element, the ridge can accommodate the sealing element within the circumference of the ridge and avoid overlaps.

According to the one hundred and forty-eighth embodiment, in one of the one hundred and forty-fifth to one hundred and forty-seventh embodiments, the system further comprises a tamper proof element having one or more, preferably two strips which are connected to the sealing element and to the head part of the stopper such that when the stopper is moved with respect to the sealing element in radial and/or axial direction, the tamper proof element is broken, and wherein the ridge formed along the perimeter of the top surface of the mouth of the bottle is broken in the sense of interrupted, and the breaks (interruptions) are adapted to allow the placement of the one or more strips.

The system with a tamper proof element informs the user if the bottle has been opened. That is, when the stopper is moved in a radial or axial direction to the sealing element, the strips on the tamper proof element are broken. The ridge on the top surface of the mouth of the bottle is broken to accommodate the strips of tamper proof element such that when the stopper is rotated, the strips are broken to signify opening of the bottle. In this embodiment, the ridge provides the additional advantage of improving the tamper proof mechanism.

According to the one hundred and forty-ninth embodiment, in the one hundred and forty-eighth embodiment, the number of breaks formed in the ridge are equal to the number of strips of the tamper proof element.

According to the one hundred and fiftieth embodiment, in one of the one hundred and forty-fifth to the one hundred and forty-ninth embodiments, the stopper is a stopper according to any of the first to one hundred and first embodiments and/or the sealing element is a sealing element according to any of the one hundred and second or one hundred and third embodiments and/or the system comprises the features described in any of the one hundred and eighth to one hundred and twenty-first embodiments.

BRIEF DESCRIPTION OF THE DRAWINGS

The present invention is further described in the detailed description which follows, in reference to the noted plurality of drawings, by way of non-limiting examples of preferred embodiments of the present invention, in which like reference signs represent like elements throughout the several views of the drawings. In the following, the numbering of the embodiments does not coincide with the numbering of the embodiments in the above summary of the invention.

FIG. 18*a* shows a front view of an outer component of the sealing element according to the sixth embodiment.

FIG. 18*b* shows a cross sectional side view of an outer component of the sealing element according to the sixth embodiment.

FIG. 19*a* shows a view of an inner component of the sealing element according to the sixth embodiment.

FIG. 19*b* shows the cross section view of the inner component of the sealing element according to the sixth embodiment.

DETAILED DESCRIPTION OF PREFERRED EMBODIMENTS

The present specification describes various embodiments of a closure system for a bottle. The bottle that can be used in combination with the closure system according to one of the various embodiments described therein may especially be a bottle designed for commercial bottling of a beverage or liquid food, in particular, among others, a wine bottle or a spirituous beverage bottle. Commercial bottling of beverages refers to bottling for the purpose of further sale, which includes transporting a bottled unit from a location of manufacture or bottling to a location of sale or use. The closure system according to one of the various embodiments described therein can also be used in combination with an oil or vinegar bottle. As far as the material of the bottle is concerned, the closure system according to one of the various embodiments described therein may be used in combination with a bottle made of glass, earthenware, plastic, ceramic or metal, to name only a few. However, a person skilled in the art would be able to use the stopper in accordance with the present invention, to fit bottle designs or jars having different shapes or sizes of opening made from different materials. It is also within the scope of the present invention to implement the stopper not just for commercial, but also for personal use for example in restaurants or homes.

Throughout this specification, terms which express relative locations or directions, like "above", "under", "up", "down", "upper", "lower", etc., refer to the natural position of the bottle, the stopper, and the sealing element, when the bottle is standing.

First Mode of the Invention

A first mode of the present invention will now be described in more detail with reference to FIGS. 1 to 16.

Stopper

Figure 1:
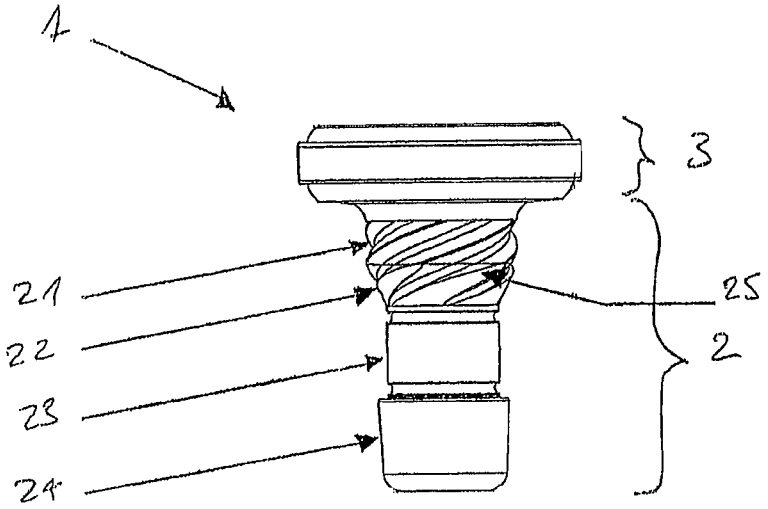
FIG. 1 shows a side view of a stopper for a bottle according to a first embodiment of the invention.

FIG. 1 shows a side view of a stopper 1 for a bottle according to a first embodiment of the invention. The stopper 1 comprises a stopper part 2 for introduction into a mouth of a bottle and a head part 3 joining the stopper part 2 via a neck portion. The head part 3 of the stopper 1 may be defined in general terms as the part of the stopper 1 protruding out of the mouth of the bottle when the bottle is sealed by the stopper 1. The neck portion may be defined in general terms as the part of the stopper 1 where the head part 3 joins the stopper part 2. The neck portion therefore represents a transition part of the stopper 1 between the head part 3 and the stopper part 2. The neck portion extends a certain distance on the stopper part 2 away from the head part 3. Therefore, the neck portion does not only comprise the portion of the stopper part 2 which is located directly under the head part 3.

In the exemplary embodiment represented with respect to FIG. 1, the neck portion may start with the curved portion located directly underneath the head part 3, where the transition portion between the head part 3 and the stopper part 2 begins, and may then further extend along the longitudinal axis of the stopper 1 over a third portion 21 and, possibly, over a fourth portion 22. However, the person skilled in the art will immediately understand that the neck portion may extend on the stopper part 2 over a distance along the longitudinal axis of the stopper 1 that may substantially vary. The neck portion may, for instance, be limited to the curved portion and the third portion 21. Further, it could also be envisaged that no curved portion is foreseen between the head part 3 and the stopper part 2, so that the neck portion would start with the third portion 21. An intermediary portion could also be foreseen between the head part 3 and the stopper part 2 instead of the curved portion, which could be a portion with a groove, i.e. a portion the diameter of which is smaller than the diameter of the third portion 21.

The head part 3 preferably has a diameter that is larger than the diameter of the stopper part 2, wherein the diameter of the head part 3 essentially corresponds to an outer diameter of the mouth of the bottle. In the case of the bottle being a wine bottle, the diameter of the head part 3 is approx. 30 mm. However, it must be noted that the dimensions of the stopper according to an embodiment of the present invention may vary depending on the specific application. Dimensions indicated in the detailed description are only for illustrative purposes and are not meant to be limiting. The person skilled in the art will can also envisage that a head part with a shape other than circular one may be provided. For example, the head part may be a polygon, in particular an even-numbered polygon like a square or a hexagon.

In the exemplary embodiment of FIG. 1, the stopper part 2 comprises a neck portion including the third portion 21 and the fourth portion 22, wherein the neck portion 21, 22 has a diameter that decreases along the longitudinal axis of the stopper 1 away from the head part 3 of the stopper 1. In the case of a bottle having an inner diameter of X±1 mm, the neck portion 21, 22 decreases along the longitudinal axis away from the head part 3 of the stopper 1 from a value of (X−4) mm±1 mm to (X−6) mm±1 mm. In the case of a wine bottle, X is roughly equal to 18.5 mm. The inner diameter of a wine bottle may therefore vary between 17.5 mm and 19.5 mm.

In the embodiment illustrated in FIG. 1, the neck portion comprises the third portion 21 having an essentially cylindrical shape and being located between the head part 3 and the fourth portion 22 along the longitudinal axis of the stopper 1. The fourth portion 22 preferably has an essentially conical shape. However, even though FIG. 1 shows the specific example of a third portion 21 having a cylindrical shape, while the fourth portion 22 has an essentially conical shape, it could also be envisaged that the neck portion decreases along the longitudinal axis away from the head part 3 of the stopper 1 along an essentially conical shape. As will be apparent from the following description, a neck portion having a third portion 21 with a cylindrical shape and a fourth portion 22 with a conical shape, as represented in FIG. 1, represents a particularly advantageous embodiment of the present invention.

In the case of a bottle having an inner diameter of X±1 mm, the third portion 21 has a diameter equal to (X−4) mm±1 mm. The fourth portion 22 therefore decreases along the longitudinal axis away from the head part 3 of the stopper 1 from the value (X−4) mm±1 mm to (X−6)±1 mm.

As apparent from FIG. 1, the stopper part 2 comprises, after the neck portion 21, 22 along the longitudinal axis of the stopper 1, a first portion 23 and a second portion 24, the first portion 23 being located between the fourth portion 22 and the second portion 24 along the longitudinal axis of the stopper 1. The first portion 23 has an essentially cylindrical shape, and the second portion 24 has a diameter that is larger than a diameter of the first portion 23. According to a preferred embodiment of the invention, the third portion has a diameter equal to (X−6) mm±1 mm, while the second portion 24 has a diameter of (X−4) mm±1 mm.

According to an embodiment of the invention, the stopper part 2 comprises a screw thread 25. According to a preferred embodiment of the invention, the neck portion 21, 22 comprises a plurality of screw threads 25 extending parallel to each other on the neck portion 21, 22 of the stopper part 2. Preferably, the number of screw threads is four to six, most preferably five. Each screw thread preferably extends on less than a full circumference of the neck portion 21, 22 of the stopper part 2. According to a particularly advantageous embodiment of the invention, each screw thread 25 extends essentially on half a circumference of the neck portion 21, 22 of the stopper part 2.

As illustrated in FIG. 1, the neck portion of the stopper is located on an upper end of the stopper part. That is, in one embodiment, the neck portion is less than 50% of the stopper part. In another embodiment, the neck portion is less than 40% of the stopper part. In yet another embodiment, the neck portion is less than 30% of the stopper part, as seen in FIG. 1. Furthermore, the length of the neck portion is similar to the length of the first or second portions on the stopper part. In another embodiment, the neck portion is not more than 120% of the length of the first or second portions on the stopper part.

Figure 2:
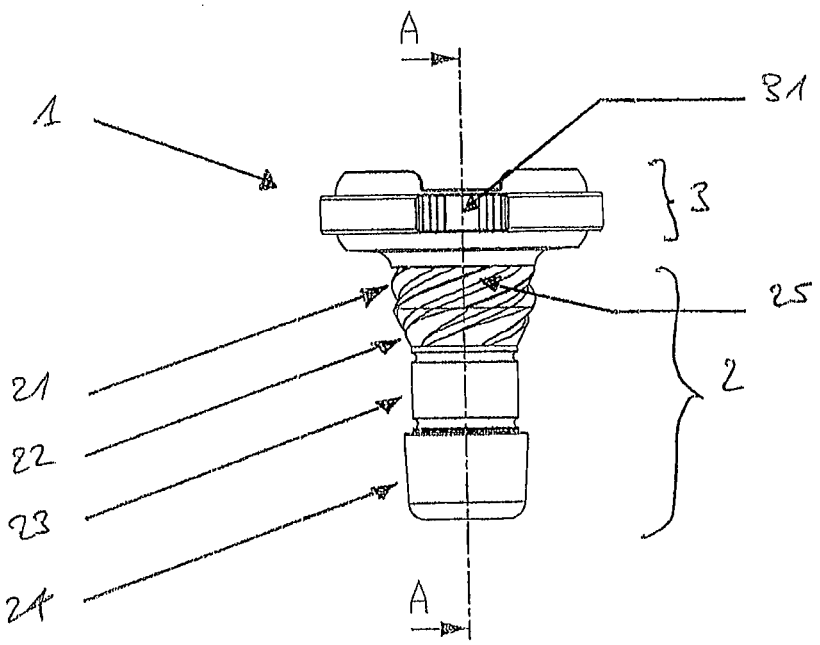
FIG. 2 shows another side view of the stopper for a bottle according to the first embodiment of the invention as represented in FIG. 1 after a rotation of 90 degrees.

In a preferred embodiment, as can be seen from FIG. 2, and dimensions referred on the exemplary embodiment, the difference of diameter at any two cross-sections of points on the stopper part 2 is not more than 30%. Similarly, the diameter of the first portion 23 is not less than 70% of the diameter of the second portion 24 of the stopper part 2. Furthermore, the diameter of the first portion 23 of the stopper part is not less than 60% of the diameter of the screw threads on the stopper part.

The above configuration of the stopper 23 ensures that the stopper part is not too thin on any part compared to the other parts of the stopper, thereby providing higher strength to the stopper and avoiding easy breaking of the stopper, especially when made from brittle materials such as glass. Furthermore, having small changes in the shape of the stopper allows for simpler molding and manufacturing process which results in a faster, better quality and cheaper stopper.

FIG. 2 shows another side view of the stopper 1 for a bottle according to the first embodiment of the invention as represented in FIG. 1 after a rotation by 90°. Further to the elements already described with respect to FIG. 1, the head part 3 comprises a pair of notches 31, 32 (only the notch 31 is shown in FIG. 2). The notches 31, 32 are formed on a lateral surface of the head part 3 at diametrically opposed positions. This specific arrangement is apparent from the top view of FIG. 5, which shows the notches 31, 32 that are arranged at diametrically opposed positions on the lateral surface of the head part 3.

Figure 3:
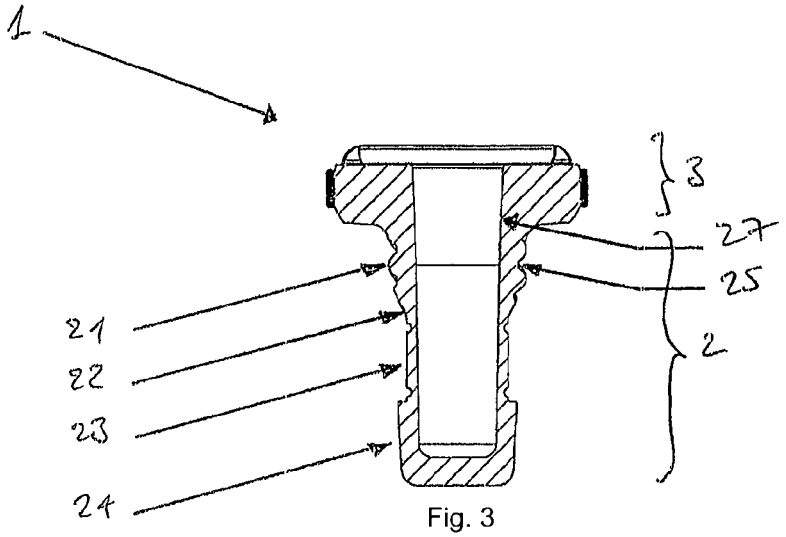
FIG. 3 shows a sectional view of a stopper for a bottle according to the first embodiment of the invention.

FIG. 3 shows a sectional view of the stopper 1 for a bottle according to the first embodiment of the invention, wherein the sectional view is taken along the lines A-A represented in FIG. 2. As can be seen in FIG. 3, a longitudinal cavity 27 is formed within the stopper 1, which extends along the longitudinal axis of the stopper 10 from a upper surface of the head part 3 of the stopper 1.

Figure 4:
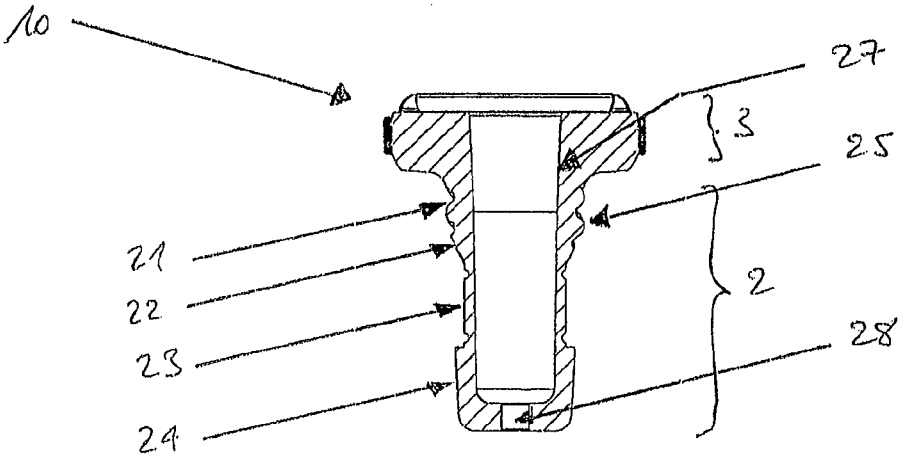
FIG. 4 shows a sectional view of a stopper for a bottle according to a second embodiment of the invention.
Figure 5:
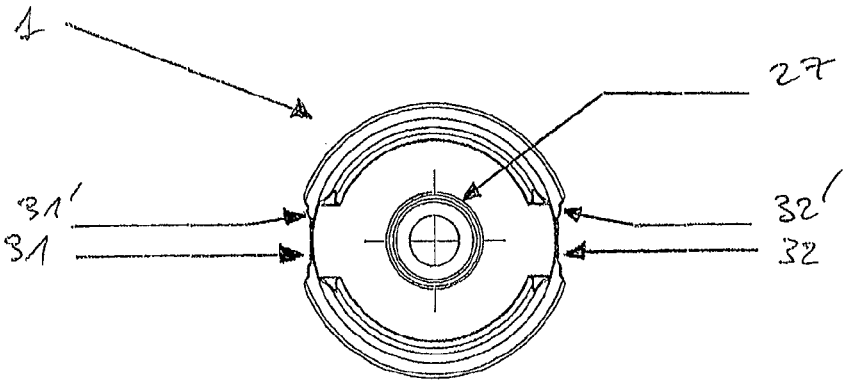
FIG. 5 shows a top view of the stopper for a bottle according to the first embodiment of the invention as represented in FIG. 3.

FIG. 4 shows a sectional view of a stopper 10 for a bottle according to a second embodiment of the invention. In this embodiment, the longitudinal cavity 27 extends throughout the stopper 10 and opens out at the tip of the stopper 10. FIG. 4 shows that the longitudinal cavity 27 opens out through an opening 28 at the tip of the stopper part 2 of the stopper 10.

The stopper 10 according to the second embodiment of the present invention is particularly advantageous when used for closing a wine bottle. The cavity also acts as a filter cavity which can be used for accommodating a filter made of a material that is both liquid-impermeable and air-permeable to a certain extent. Such a filter can be manufactured, for instance, out of the Saranex™ material produced by Dow Chemicals, to name only one possible material. The filter is hermetically arranged at the bottom of the longitudinal cavity 27 in direct contact with the opening 28, which allows for controlling the amount of oxygen that can penetrate into the wine bottle. By doing so, the maturing process of a wine can be controlled.

By way of illustration only, the dimensions of the stopper 1, 10 according to the first and second embodiments of the invention may be as follows, wherein these dimensions, as already mentioned above, are not meant as being limiting, but rather to give the person skilled in the art indications to help him/her to carry out the embodiments of the invention.

In case of the bottle being a wine bottle, the outer diameter of the head part 3 of the stopper may be approximately 3 mm, while the length of the stopper along its longitudinal axis may be around 35 mm, when measured from the upper surface of the head part 3 to the tip of the stopper part 2. The length of the head part 3 along the longitudinal axis of the stopper may be approximately 9 mm, and the length of the stopper part 2 may therefore be approximately 26 mm. The third portion 21 of the stopper part 2 preferably has a cylindrical shape having a diameter of roughly 15 mm and a length along the longitudinal axis of the stopper of about 4 mm. The fourth portion 22 has a diameter that decreases from the third portion 21, i.e. about 15 mm, to about 13 mm, wherein the fourth portion 22 has a length along the longitudinal axis of the stopper of about 4 mm. The first portion 23 has a length along the longitudinal axis of the stopper of about 6 mm and a diameter of about 13 mm. Finally, the second portion 24 has a diameter of roughly 15 mm and a length along the longitudinal axis of the stopper of about 9 mm. Though the measurements mentioned above are exemplary embodiments, the diameter and length of the second portion is designed such that, depending on the material used, the second portion has an optimal volume and mass to ensure easy bottling, details of which are explained later in the specification. Furthermore, a person skilled in the art would be able design the second portion to be of a different shape or combination of shapes, than cylindrical as described in the embodiment above, by maintaining the largest cross sectional length (or diameter) of the second portion larger than the first portion.

According to the embodiment shown in FIGS. 3 and 4, the longitudinal cavity 27 has a diameter that slightly decreases along the longitudinal axis of the stopper away from the head part 3. For illustration purposes only, the diameter of the longitudinal cavity 27 at the upper surface of the head part 3 may be roughly 10 mm and the diameter at the bottom of the longitudinal cavity 27 within the stopper part 2 may be 8 mm. Further, as shown in the embodiment of FIG. 4, the cavity 27 may open out at an opening 28 that may have a diameter of 3 mm, for example.

The term "opening out" when used herein relates to the opening which has the access to the air, either into the bottle or out of the bottle.

Referring back to FIG. 5, it is apparent that the head part 3 comprises a pair of notches 31, 32, that are disposed on a lateral surface of the head part 3 at diametrically opposed positions. In each notch 31, 32, small protuberances 31', 32' are provided, in order to increase the friction, when a user uses his fingers, for instance his thumb and his index, to hold the notches 31, 32 for opening the bottle.

Figure 6:
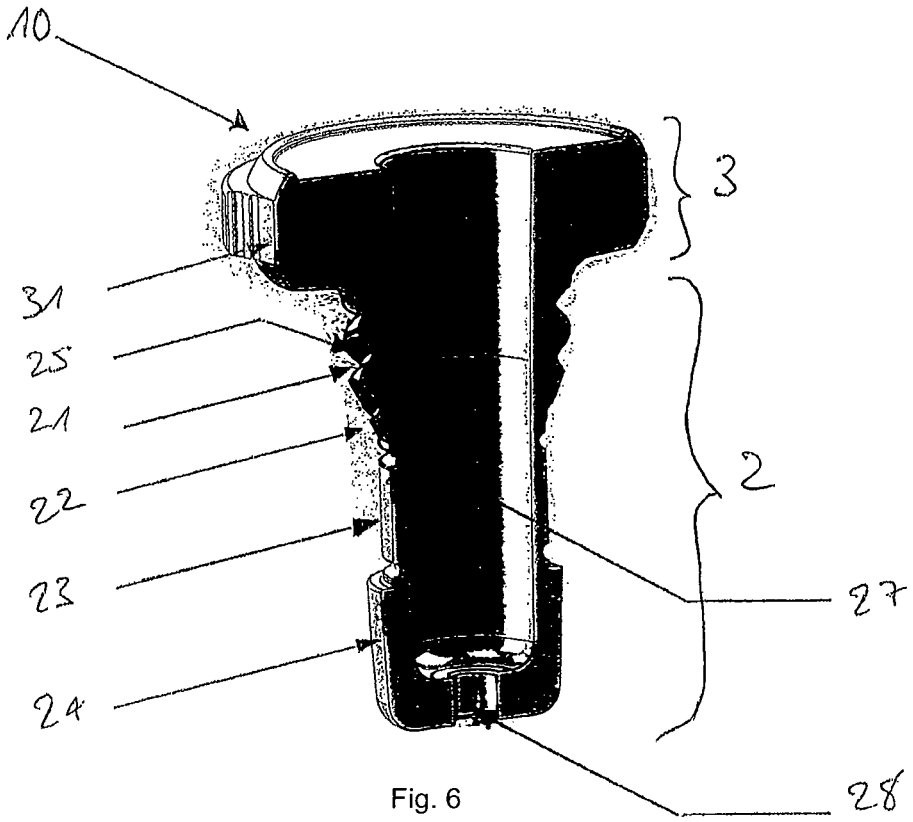
FIG. 6 shows a perspective cross-sectional view of the stopper for a bottle according to the second embodiment of the invention.

FIG. 6 shows a perspective cross-sectional view of a stopper 10 for a bottle according to the second embodiment of the invention. FIG. 61 reveals the inside of the stopper 10 and, in particular, the inside walls of the longitudinal cavity 27. It further shows the opening 28, out of which the longitudinal cavity 27 opens out from the stopper 10.

Figure 7:
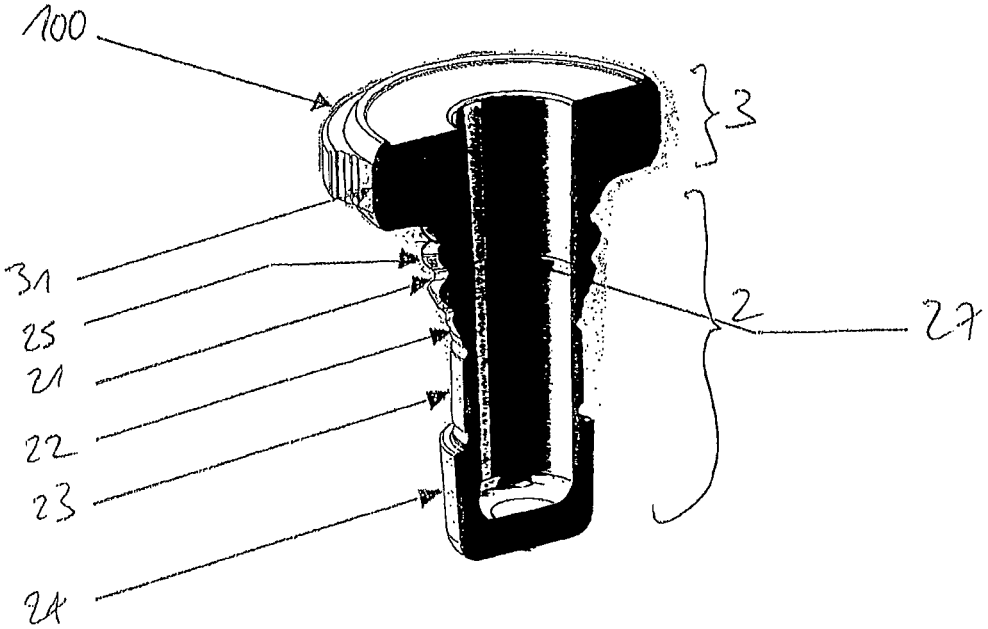
FIG. 7 shows a perspective cross-sectional view of a stopper for a bottle according to a third embodiment of the invention.

FIG. 7 shows a perspective cross-sectional view of a stopper 100 for a bottle according to a third embodiment of the invention. The stopper 100 for a bottle according to the third embodiment of the invention differs from the stopper 10 for a bottle according to the second embodiment in that no opening is provided at the tip of the stopper part 2, so that the longitudinal cavity 27 does not open out at the tip of the stopper part 2. The longitudinal cavity 27 therefore only opens out at the upper surface of the head part 3, as apparent from FIG. 7.

As it will be appreciated by the skilled person, the stopper with a longitudinal cavity as described above can be implemented in any such closure system and not only for the closure systems as described above, where the stopper part comprises an interlocking mechanism for engaging with a counterpart interlocking mechanism of the sealing element, and where the interlocking mechanisms are configured to permit bringing the sealing element into an unsealed position by an unsealing action which comprises rotating the stopper with respect to the bottle. For example, the cavity can advantageously be used in combination with the prior art stopper as described in EP 1 456 092 B1.

Sealing Element

Figure 8:
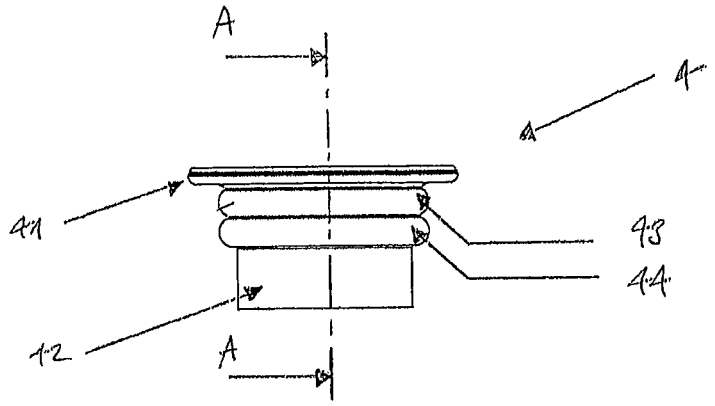
FIG. 8 shows a side view of a sealing element for sealing a stopper for a bottle according to one of the first to third embodiments of the invention.

FIG. 8 shows a side view of a sealing element 4 for sealing a stopper for a bottle, preferably a beverage bottle, like a wine bottle, according to the first mode of the invention. The sealing element 4 is separate from the bottle, i.e. it does not form part of the bottle, nor is it attached to the bottle. The sealing element 4 comprises a sealing part 42 for sealing a stopper part 2 of a stopper 1, 10, 100 according to an embodiment of the invention against an inner wall of the mouth of the bottle in the sealed position. The sealing element 4 is formed such that the stopper part 2 of the stopper 1, 10, 100 can be introduced into it. For instance, the sealing part 42 of the sealing element 4 may essentially have the shape of a ring or a tube.

The sealing element 4 preferably further comprises an upper part 41 joining the sealing part 42, the upper part 41 allowing for sealing a head part 3 of a stopper 1, 10, 100 according to an embodiment of the present invention against a mouth of the bottle in a sealed position in the mouth of the bottle. The upper part 41 of the sealing element 4 extends essentially perpendicularly to the sealing part 42 of the sealing element 4. This allows for a particularly secure and reliable sealing of the mouth of the bottle thanks to the stopper and the sealing element according to the embodiments of the present invention. Furthermore, in this embodiment, the head part 3 of the stopper does not come into direct contact with the top of the mouth of the bottle, preventing that the stopper or the bottle are broken or damaged when the stopper is introduced into the mouth of the bottle with some force. Finally, this embodiment also helps to prevent that the sealing element 4 slips (deeper) into the mouth of the bottle when the stopper is introduced into the mouth and prevents damages during transport.

However, the upper part 41 exerts frictional force in the radial direction between the lower surface of the head part and the upper surface of the mouth of the bottle. However, a higher frictional force in the radial direction between the head part and the sealing element when compared to the frictional force between the sealing element and the glass bottle results in rotating the sealing element with the stopper, thereby causing the spinning of the sealing element in the bottle. Such spinning of the sealing element in the bottle makes it difficult to open the bottle by rotation of the stopper. In order to avoid this high frictional force on the upper surface, a means for reducing the rotational friction between the head part of the stopper and the upper surface of the upper part of the sealing element is provided. This means for reducing the rotational friction between the head part of the stopper and the upper surface of the upper part of the sealing element can be at least one rim which is provided on the upper surface of the upper part of the sealing element. This rim is formed as a continuous circle, thereby reducing the area of contact to the head part and thereby reducing the rotational friction between the head part of the stopper and the upper part of the sealing element.

The sealing element 4 according to an embodiment of the invention is made of a flexible and/or elastic material, such as natural rubber, bio-based and/or bio-degradable silicone, to name only a few possible materials. Preferably, a shape memory material is chosen, which enables a compression of at least parts (e.g. the sealing part 42) of the sealing element 4 in the sealed position and a decompression of at least parts (e.g. the sealing part 42) of the sealing element in the unsealed position such that the sealing element springs back into its original shape, i.e. the shape it had prior to compression, upon bringing the sealing element into the unsealed position.

Figure 9:
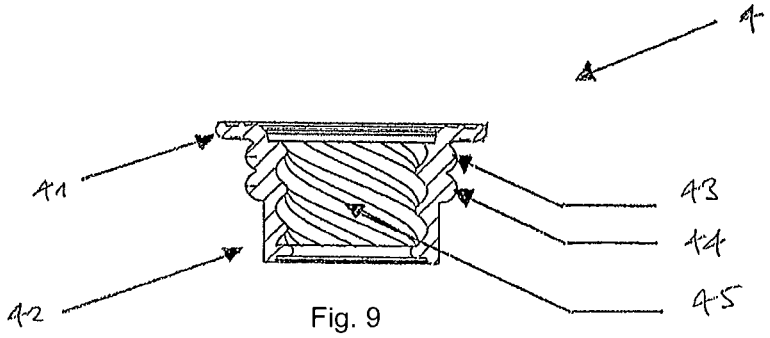
FIG. 9 shows a sectional view along the line A-A of the sealing element for sealing a stopper for a bottle according to one of the first to third embodiments of the invention as represented in FIG. 8.

The sealing part 42 of the sealing element 4, according to the embodiment of the invention, is an essentially cylindrically shaped ring having an opening at both the top and bottom ends of the sealing element. The opening on the bottom of the sealing element has a diameter which is essentially identical to the diameter of the opening on the top of the sealing element as illustrated in the cross-sectional view as seen in FIG. 9. At the most, the diameter of the opening in the bottom of the sealing element varies from a diameter of the opening on the top of the sealing element by 20%. The essentially cylindrically shaped ring with the circular openings provided on each ends of the sealing element 4 allows the stopper part of the stopper to pass through them.

These dimensions of the sealing element contribute to the design of the overall size of the sealing element in relation with the size of the stopper. In general, it is advantageous to provide a sealing element with a size which is relatively smaller than the stopper part. This is because, in the bottling process, it is easier to introduce a stopper having a relatively smaller length sealing element rather than a stopper having a longer length sealing element, since the force required to be exerted in order to seal the bottle can be applied for a relatively smaller time, thereby ensuring a faster bottling process.

Figure 11:
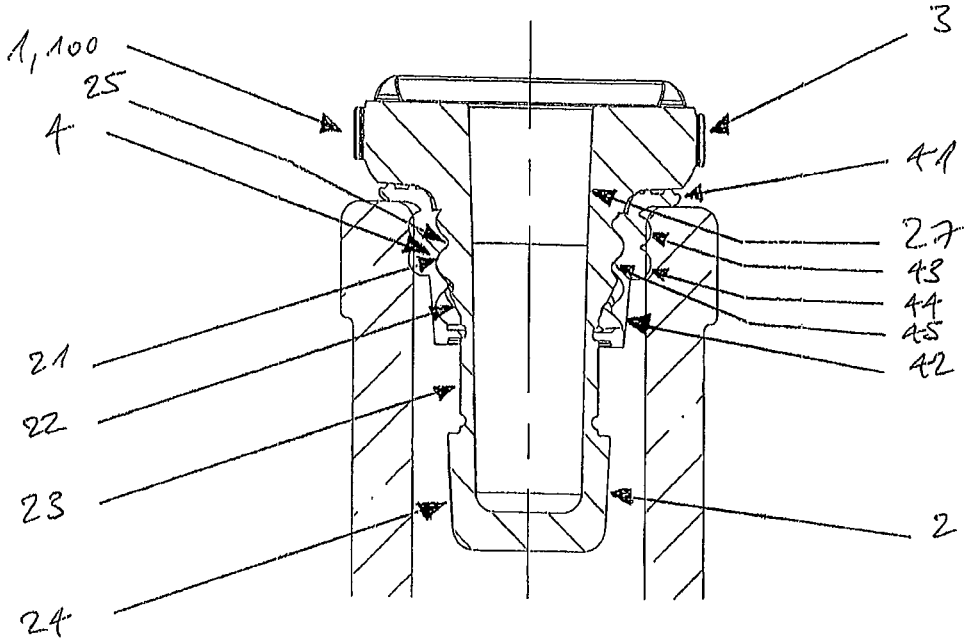
FIG. 11 shows a sectional view of a stopper for a bottle according to the first to third embodiments of the invention with a sealing element that is arranged on a stopper part of the stopper in a sealed position.

In a preferred embodiment, the smaller sealing element is achieved by designing the sealing element whose length is not greater than essentially half of the length of the stopper part, as seen in the embodiment illustrated in FIG. 11.

When considering the length of the sealing element with respect to the diameter of the sealing element, it can be seen that in the embodiment illustrated in FIG. 11, the length of the sealing element is not greater than the outside diameter of the sealing element. As will be understood by the person skilled the art, the outside diameter of the sealing element is essentially the same as the inner diameter of the mouth of the bottle. Therefore, having the length of the sealing element equal to or not greater than 120% of its diameter results in a smaller length of the sealing element compared to the stopper.

Still referring to FIG. 8, the sealing element 4 preferably comprises two adjacent ribs 43, 44, which are formed in an outer portion of the sealing part 42, preferably located next to a junction between the upper part 41 and the sealing part 42. The two adjacent rings 43, 44 are formed, dimensioned and arranged in such a manner that they can be pressed against the inner wall of the mouth of the bottle upon introducing the stopper part 2 of a stopper 1, 10, 100 according to an embodiment of the invention into the mouth of the bottle. Upon being pressed against the inner wall of the mouth of the bottle, the air caught between the adjacent ribs 43, 44 and the inner wall of the mouth of the bottle is removed and the ribs 43, 44 adhere strongly at the surface of the inner wall of the mouth of the bottle. This particularly secure and reliable adherence of the sealing element on the inner wall of the bottle ensures a particularly secure and reliable sealing of the sealing element, when the stopper part exerts pressure on the sealing element upon introduction of the stopper part into the mouth of the bottle.

For illustration purposes only, dimensions of a sealing element 4 according to an embodiment of the invention may be as follows. The upper surface of the sealing element 4 may have a width of roughly 24 mm and a lower part of the sealing element 4 may have a width of roughly 15 mm. The adjacent ribs 43, 44 may have an outer diameter, in a non-contracted state, of about 18 mm. The sealing element 4 may have a total length along the longitudinal axis of about 12 mm. Each ring 43, 44 may have a length along the longitudinal axis of the sealing element 4 of about 2.5 mm.

FIG. 9 shows a sectional view along the line A-A of the sealing element 4 for sealing a stopper 1, 10, 100 for a bottle according to an embodiment of the invention as represented in FIG. 8. The inner wall formed in the sealing part 42 of the sealing element 4 is apparent from FIG. 9. At least one screw thread 45 is formed on the inner wall of the sealing part 42. The inner wall of the sealing part 42 may comprise one screw thread 45 that is adapted to interact with one screw thread 25 of the stopper part 2 of a stopper 1, 10, 100 according to an embodiment of the invention.

According to a preferred embodiment of the invention, the inner wall of the sealing part 42, however, comprises a plurality of screw threads 45 extending parallel to each other on the inner wall of the sealing part 42. According to an advantageous embodiment of the invention, the inner wall comprises four to six, preferably five screw threads 45 extending on the surface of the inner wall of the sealing part 42. Each screw thread 45 preferably extends on less than a full circumference of the inner wall of the sealing part 42. It is particularly advantageous if each screw thread extends essentially on half a circumference of the inner wall of the sealing part 42.

The screw thread 45 or the plurality of screw threads 45 arranged on the inner wall of the sealing part 42 of the sealing element 4 is formed and dimensioned in such a manner that it corresponds to the screw thread 25 or the plurality of screw threads 25 of the stopper part 2 of a stopper 1, 10, 100 according to an embodiment of the invention.

Figure 10:
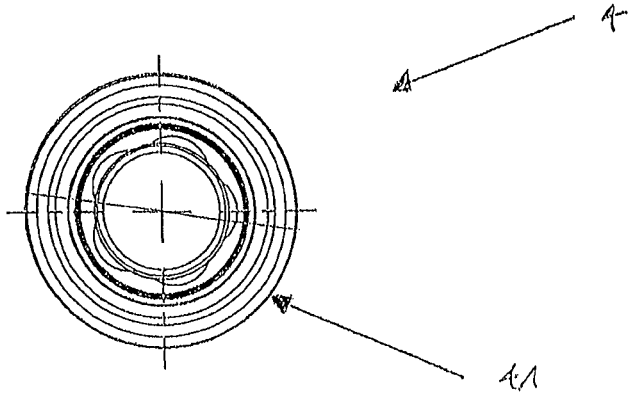
FIG. 10 shows a top view of a sealing element for sealing a stopper for a bottle according to the first to third embodiments of the invention.

FIG. 10 shows a top view of a sealing element 4 for sealing a stopper for a bottle according to an embodiment of the invention. It shows the upper part 41 of the sealing element 4 from the top. The surface of the upper part 41 is the surface on which the bottom surface of the head part 3 of the stopper 1, 10, 100 according to an embodiment of the invention will lie after introduction of the stopper into the mouth of the bottle. The sealing element 4 comprises a central opening into which the stopper part 2 of a stopper according to an embodiment of the invention is to be introduced. As apparent from FIGS. 9 and 10, the diameter of the opening in the upper part 41 of the sealing element 4 is preferably larger at the level of the upper surface of the upper part 41 than it is further down within the upper part 41, in order to facilitate an introduction of the stopper part 2 of a stopper according to an embodiment of the invention. For the same reason, the diameter of the opening in the upper part 41 of the sealing element is preferably larger than the diameter of a central opening of the sealing part 42 of the sealing element.

Sealed Position

FIG. 11 is a sectional view of a stopper according to an embodiment of the present invention and a sealing element according to an embodiment of the present invention in a sealed position in a mouth of a bottle (not represented). In the sealed position of the sealing element, at least a portion of the stopper part 2 of the stopper presses at least a portion of the sealing element 4 against an inner wall of the mouth of the bottle. In the case of the embodiment shown in FIG. 11, the third portion 21 of the stopper part 2 of the stopper, which has a larger diameter than the fourth portion 22 of the stopper part 2, presses the sealing part 42 of the sealing element 4 against an inner wall of the mouth of the bottle.

The pressing force is achieved by an appropriate selection of the dimensions of at least parts (e.g. the third portion 21) of the stopper part 2 of the stopper and at least parts (e.g. the sealing part 42) of the sealing element 4 with respect to the inner diameter of the mouth of the bottle. For example, the thickness of (parts of) the sealing element is selected such that it is greater than the difference between the radius of the inner wall of the mouth of the bottle and the radius of (parts of) the stopper part 2 of the stopper. As a consequence, at least parts of the sealing element 4 are compressed in the sealed position.

According to a preferred embodiment of the present invention, the third portion 21 of the stopper part 2 has a cylindrical shape which allows for pressing the sealing part 42 of the sealing element 4 against the inner wall of the bottle on the whole surface of the cylindrical third portion 21 of the stopper part 2. This permits exerting a strong force onto the sealing part 42 of the sealing element 4 towards the inner wall of the bottle at a neck portion of the sealing part 42 of the sealing element 4.

As mentioned above, according to a preferred embodiment of the present invention, the two adjacent ribs 43 and 44 are arranged at this neck portion of the sealing part 42 of the stopper part 2. Hence, the cylindrical third portion 21 of the stopper part 2, by exerting a strong force onto the sealing part 42 of the sealing element 4, presses the two adjacent ribs 43, 44 against the inner wall of the bottle. This enables a particularly secure and reliable adherence of the sealing element 4 on the inner wall of the bottle.

As illustrated in FIG. 11, in the sealed position the sealing part is located on an upper end of the stopper part. That is, in one embodiment the sealing part 42 is located at a height of the upper 60% of the stopper part. In another embodiment, the sealing part 42 is located at a height of the upper 50% of the stopper part. In yet another embodiment, the sealing part 42 is located at a height of up of 30% of the stopper, which is seen in FIG. 11.

Providing the sealing part on the upper end of the stopper in the sealed position allows for easier bottling and insertion into the bottle. This is because since sealing part is on the upper end of the stopper part in a sealed position, it comes in contact with the mouth of the bottle only at the last instance as compared to providing a sealing part throughout the stopper part. This result in a faster bottling process compared to other design of closure systems as it will be described later.

Unsealed Position

Figure 12:
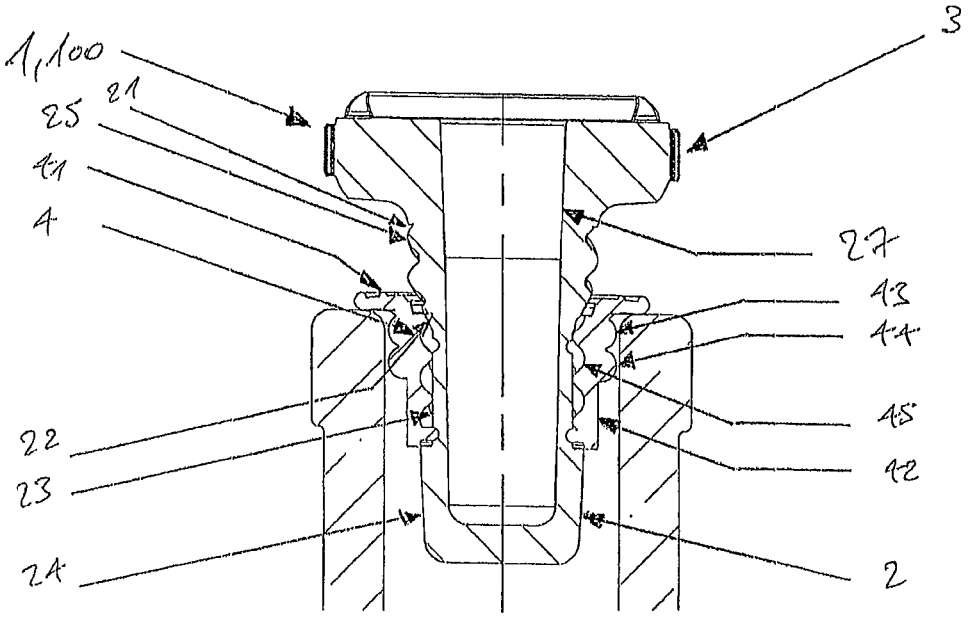
FIG. 12 shows a sectional view of the stopper for a bottle according to the first to third embodiments of the invention with a sealing element according the invention that is arranged on a stopper part of the stopper in a position during the process of opening the bottle.

FIG. 12 is a sectional view showing a stopper and a sealing element according to an embodiment of the present invention in an unsealed position during the process of opening the bottle. FIG. 12 shows that the third portion 21 of the stopper part 2 of the stopper does not press the sealing part 42 of the sealing element 4 towards the inner wall of the mouth of the bottle anymore, as was the case in the sealed position. In the sectional view of FIG. 12, the stopper protrudes out of the sealing element 4 on a distance which is essentially equal to the length of the third portion 21 of the stopper 2 along the longitudinal axis of the stopper. FIG. 12 shows that the fourth portion 22 of the stopper part 2 of the stopper is in contact with the inner wall of the sealing part 42 of the sealing element 4 at a level corresponding to the neck portion of the sealing part 42, where the adjacent ribs 43, 44 are arranged on the outer portion of the sealing part 42.

Due to the fact that the fourth portion 22 of the stopper part 2 of the stopper has a reduced diameter compared to the diameter of the third portion 21 of the stopper part 2, the pressure exerted on the inner wall of the sealing part 42 of the sealing element 4 at the height of the neck portion, where the adjacent ribs 43, 44 are arranged, is smaller than the pressure which was exerted by the third portion 21 of the stopper part 2 in the sealed position. Since the sealing element 4 is made out of an elastic material enabling a decompression of the sealing part 42 as a result of a reduced pressure thereon, the neck portion of the sealing part 42 retracts from the compressed (sealed) position shown in FIG. 11. Hence, the inner wall of the sealing part 42 of the sealing element 4 is in contact with the fourth portion 22 of the stopper part 2 at the height of the neck portion of the sealing part 42 of the sealing element 4. The first portion 23 of the stopper part 2 is in contact with the inner wall of the sealing part 42 of the sealing element 4 at the level of the portion of the sealing part 42 of the sealing element 4 which is comprised between the neck portion and the end of the sealing part 42 of the sealing element 4.

As mentioned above, according to a preferred embodiment of the present invention, the stopper part 2 has a second portion 24, the diameter of which is larger than the diameter of the first portion 23. This larger diameter of the second portion (24) of the stopper part (2) ensures that in the unsealed position upon pulling the stopper 1, 10, 100 out of the mouth of the bottle, the sealing element is retained on the stopper part (2) of the stopper. In the position represented in FIG. 12, it can be seen that the end of the sealing part 42 of the sealing element 4 abuts at the junction between the first portion 23 and the second portion 24 of the stopper part 2.

Initial Sealing Action

It will now be explained how a bottle is sealed using the closure system according to an embodiment of the present invention. First, a sealing element 4 is put onto a stopper part 2 of a stopper 1, 10, 100. Preferably, the sealing element 4 is arranged on the stopper 1, 10, 100 so that the end of the sealing part 42 of the sealing element 4 abuts with the junction between the first portion 23 and the second portion 24 of the stopper part 2 of the stopper 1, 10, 100. However, the exact relative position of the stopper 1, 10, 100 with respect to the sealing element 4 may differ. Then, the stopper part 2 with the sealing element 4 arranged thereon is introduced into the mouth of the bottle until the sealed position is reached.

Preferably, the stopper part 2 is introduced on to the bottle by first dropping the stopper on to the mouth of the bottle and then pressing it. To ensure that during dropping the stopper lands in an upright longitudinal position into the mouth of the bottle, the stopper is designed to be in equilibrium when subjected to gravity. This equilibrium is achieved by designing the second portion to have adequate volume and mass by means of having an optimal length and diameter in comparison to other portions of the stopper, and considering the material used for manufacturing the stopper. However, while determining the optimal diameter, it should be considered that the diameter is neither too small nor too large. A second portion should have a larger diameter in comparison to the first portion to ensure that be sealing element is retained on the stopper at the same time, should have a adequately smaller diameter than the mouth of the bottle so as to not hinder the bottling process. Due to the fact that the neck portion 21, 22 of the stopper part 2 of the stopper 1, 10, 100 has a diameter decreasing along the longitudinal axis away from the head part 3 of the stopper 1, 10, 100, the sealing element 4 is compressed against the inner wall of the bottle, until the sealed position is reached. Alternatively or in addition to pressing, the stopper can be rotated so that the means for interacting with the sealing element pull the stopper down into the bottle mouth.

Unsealing Action

It will now be explained in detail how the sealing element can be brought by the user from the sealed position represented in FIG. 11 to the unsealed position shown in FIG. 12. By putting his/her fingers on the head part 3 of the stopper, according to a preferred embodiment of the present invention, preferably on notches 31, 32 of the head part 3, the user can exert a rotation of the stopper about the longitudinal axis of the stopper. While doing so, the bottle is held firmly, so that the stopper is rotated with respect to (relative to) the bottle.

However, the stopper is rotated not only with respect to (relative to) the bottle, but also with respect to (relative to) the sealing element. The bottle and the sealing element remain in place while the stopper is rotated (or vice versa). A rotation of the stopper with respect to the sealing element, which is separate from and not attached to the bottle, is achieved due to the fact that the sealing element 4 securely adheres to the inner wall of the mouth of the bottle. In particular, the adhesive force between the inner wall of the sealing element 4 and the stopper part 2 is smaller than the adhesive force between the outside wall of the sealing element 4 and the inner wall of the mouth of the bottle. This is achieved, e.g., by the inner wall of the sealing element 4 having a lower friction coefficient on the material of the stopper (for instance glass, plastic, ceramic, or wood) than the outer wall of the sealing element 4 on the material of the bottle (for instance glass, plastic, ceramic, or wood), or by the two adjacent ribs 43, 44. In order to achieve that the inner wall of the sealing element 4 has a lower friction coefficient than the outer wall of the sealing element, the sealing element may be made of two components, or the inner wall may be coated.

Since in a preferred embodiment, the stopper part 2 comprises at least one screw thread 25 extending on the third portion 21 and the fourth portion 22 of the stopper part 2, and the sealing element 4 comprises an inner wall in the sealing part 42, which comprises at least one corresponding screw thread 45, an interaction between the screw thread 25 of the stopper part 2 and the screw thread 45 of the sealing element 4 can take place. The effect of this interaction is that the stopper is moved upwards, i.e. along the longitudinal axis of the stopper 4 and in the direction out of the mouth of the bottle, provided the rotation is exercised in the right direction. Consequently, by exerting a rotation movement about the longitudinal axis of the stopper, the user can bring the sealing element from the sealed position represented in FIG. 11 to the unsealed position represented in FIG. 12.

In the various embodiments of the present invention described herein, the dimensions of the stopper 1, 10, 100 and the sealing element 4 with respect to the diameter of the bottle mouth are selected in such a manner that the force that is exerted on the inner wall of the bottle is sufficiently large to hold the stopper in an axial and radial direction. Preferably, the dimensions of the stopper 1, 10, 100 and the sealing element 4 with respect to the diameter of the bottle mouth are selected in such a manner that the force exerted on the inner wall of the bottle is sufficiently high to eliminate the need for any additional fixing element, for example a fixing element attached to the bottle body, for fixing the stopper during transport of the bottle or during storage in a horizontal position. Further, the dimensions of the stopper 1, 10, 100 and the sealing element 4 with respect to the diameter of the bottle mouth should preferably be selected in such a manner that the force exerted on the inner wall of the bottle is such that the stopper can still be easily opened by rotating it by hand.

As outlined above, in the position represented in FIG. 12, the end of the sealing element 4 abuts at the junction between the first portion 23 and the second portion 24 of the stopper part 2, due to the difference in diameter between the first portion 23 and the second portion 24. In order to completely open the bottle, the user only needs to pull the stopper along the longitudinal axis away from the bottle. By doing so, the second portion 24 of the stopper part 2 exerts a force on the end of the sealing part 42 of the sealing element 4 in the same pulling direction. This force will allow for removing any remaining adherence of the sealing part 42 to the inner wall of the bottle, caused, e.g., by the two adjacent ribs 43, 44. Consequently, the whole system comprising the stopper and the sealing element 4 can be easily removed from the mouth of the bottle.

Resealing Action

In order to re-seal the bottle, the user simply needs to put the system back into the mouth of the bottle and exert a rotation in the opposite direction as for opening, which will allow for screwing back the stopper part onto the sealing element 4. This rotation in the opposite direction as for opening will lead to the third portion 21 of the stopper part 2 to exert pressure on the inner wall of the sealing part 42 of the sealing element 4, thereby exerting pressure on the adjacent ribs 43, 44 and thus re-establishing the adherence to the inner wall of the bottle. Consequently, the sealing element can be brought back into a sealed position by the user by simply rotating the stopper, preferably the head part 3 of the stopper. Alternatively, the bottle can be re-closed by simply pushing the stopper part 2 with the sealing element 4 into the mouth of the bottle, with a certain force.

Other Embodiments of the First Mode of the Invention

Figure 13:
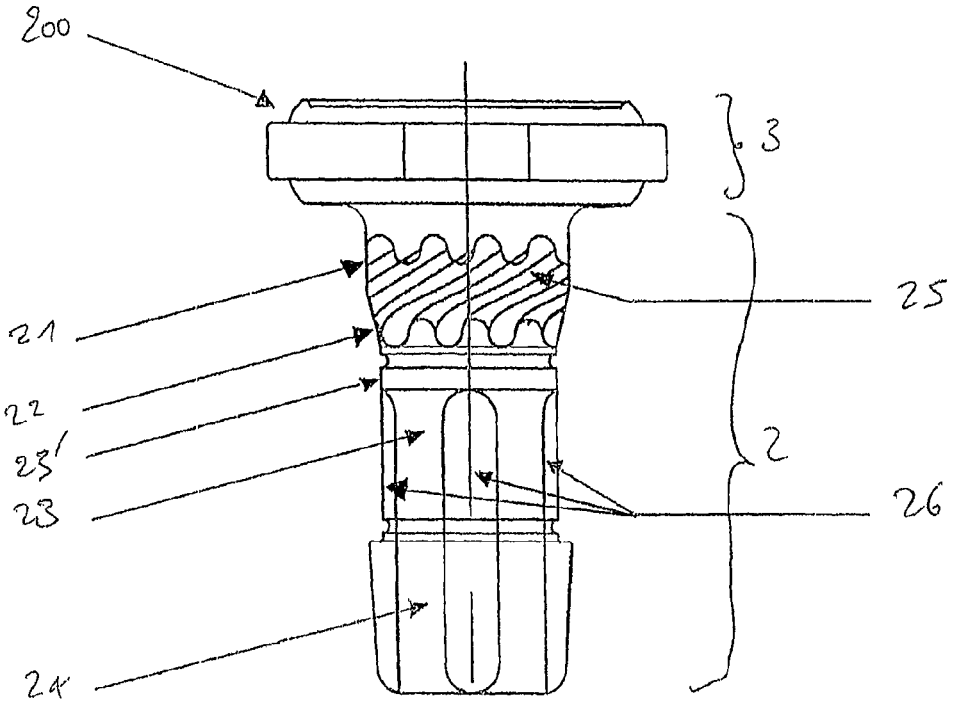
FIG. 13 shows a side view of a stopper for a bottle according to a fourth embodiment of the invention.

FIG. 13 shows a side view of a stopper 200 for a bottle according to a fourth embodiment of the invention. A plurality of channels 26 are formed on the first portion 23 and the second portion 24 of the stopper part 2. These channels 26 extend parallel to the longitudinal axis of the stopper 200 from a tip of the stopper 200. According to an advantageous embodiment of the invention, four channels 26 are formed on the first portion 23 and the second portion 24, wherein the channels 26 are equidistant from each other, i.e. are arranged at 9° from each other around the longitudinal axis of the stopper 200. Each channel is preferably a longitudinal channel extending from the tip of the stopper 200 on the whole second portion 24 and on most of the first portion 23. Indeed, according to an advantageous embodiment of the invention, the channels 26 do not extend until the junction between the first portion 23 and the fourth portion 22, so as to leave a part 23' of the first portion 23 with no channels formed therein. The part 23' of the first portion 23 therefore has a diameter that is equal to the diameter of the essentially cylindrical first portion 23, as in the first, second and third embodiments of the present invention. In a bottle comprising a sparkling beverage, e.g. a sparkling wine, the channels allow for easily releasing the inner pressure within the beverage bottle.

Figure 14:
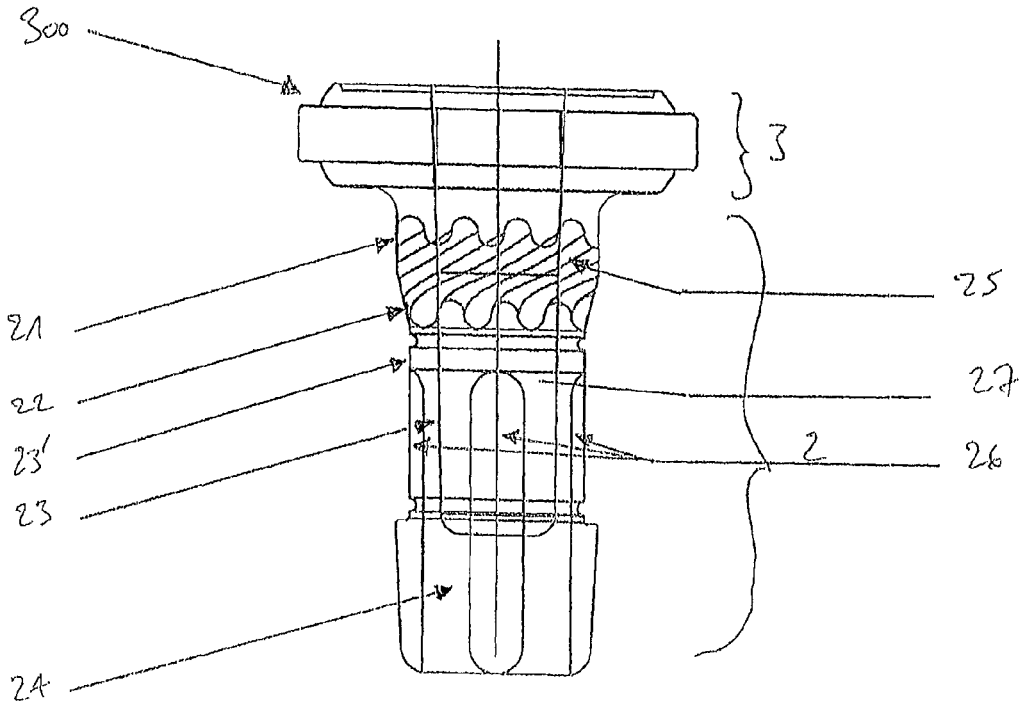
FIG. 14 shows a side view of a stopper for a bottle according to a fifth embodiment of the invention.

FIG. 14 shows a side view of a stopper 300 for a bottle according to a fifth embodiment of the invention. FIG. 14 shows a longitudinal cavity 27 in solid lines, which represents a longitudinal cavity 27 formed within the stopper 300. The longitudinal cavity 27 extends along the longitudinal axis of the stopper 300 from an upper surface of the head part 3 up to a bottom located within the stopper 300.

Figure 15:
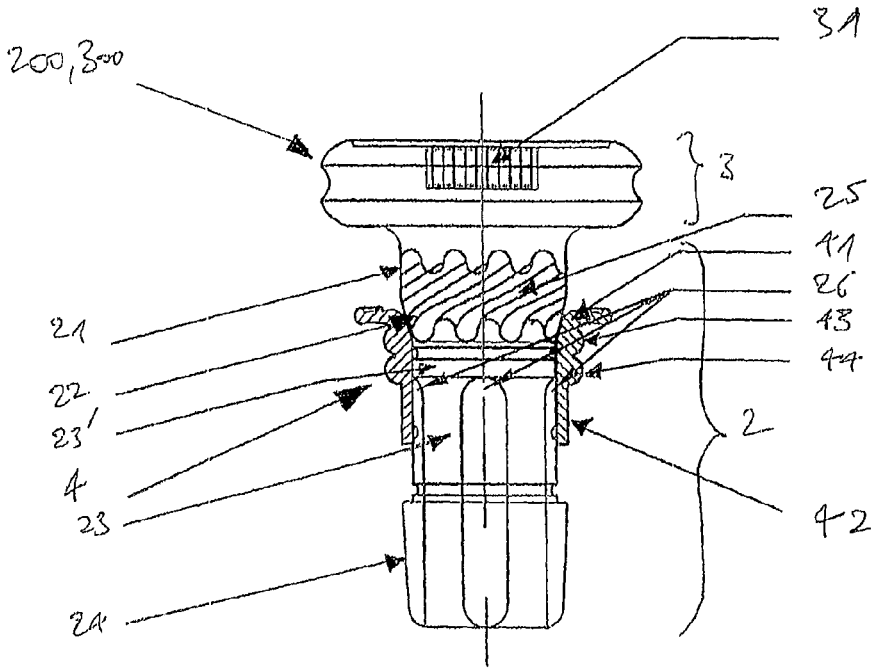
FIG. 15 shows a side view of the stopper for a bottle according to the fourth or fifth embodiments of the invention with a sealing element according to an embodiment of the invention that is arranged on a stopper part of the stopper.

FIG. 15 shows a side view of the stopper 200, 300 for a bottle according to a fourth or fifth embodiment of the invention with a sealing element 4 according to an embodiment of the invention that is arranged on the stopper part 2 of the stopper 200, 300. The sealing element 4 is shown in an intermediate position in the process of being brought from the sealed position to the unsealed position by the user.

Figure 16:
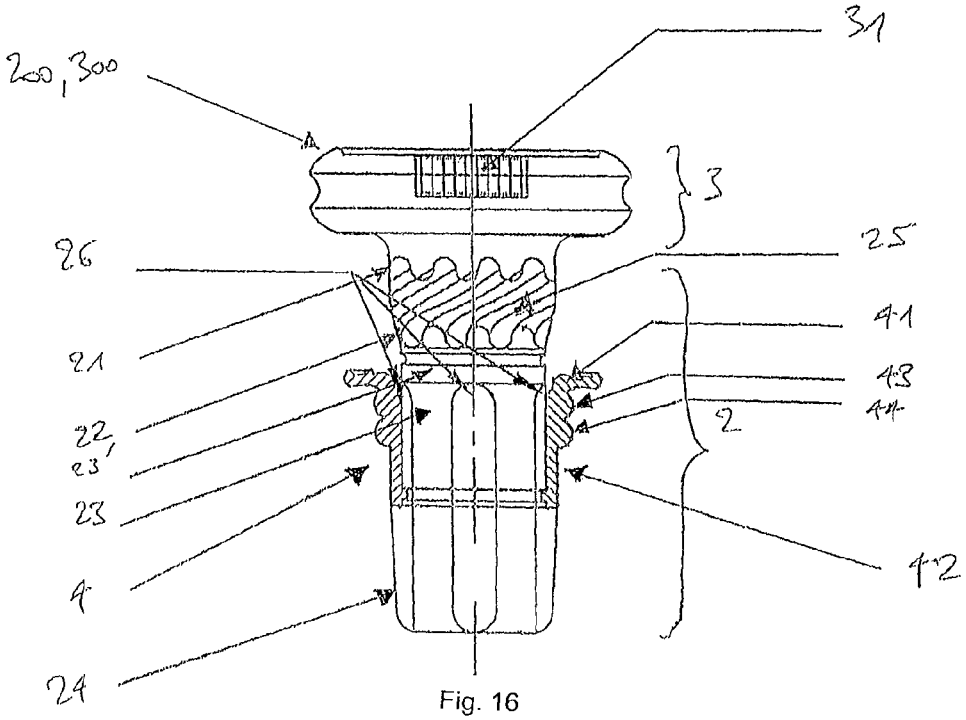
FIG. 16 shows a side view of the stopper for a bottle with a sealing element that is arranged on a stopper part of the stopper as represented in FIG. 15 in an unsealed position.

FIG. 16 shows a side view of the stopper 200, 300 as represented in FIG. 15 in a later stage of the process of bringing the sealing element into the unsealed position. FIG. 16 shows that the channels 26, in this position, enable a communication between the inside of the bottle and the outside air, since passageways exist through the openings formed between the part 23' of the first portion 23, on which the channels 26 do not extend, and the inner surface of the sealing element 4. This embodiment is particularly advantageous for an application with beverage bottles containing a sparkling wine, which has a relatively high inner pressure within the bottle, which may be as high as 5 to 7 bars for Champagne wines, for instance, under normal temperature conditions, or even higher at a higher temperature. This embodiment enables the pressure to be released into the outside air using the channels 26 as passageways. Depending on the speed of opening the bottle, the inner pressure within the bottle will be released more or less slowly. If the bottle is opened in a slow manner, passageways between the part 23' of the first portion 23 and the inner surface of the sealing element 4 are created in a slow manner, which leads to a slow pressure release. On the other hand, if the bottle is opened quickly by the user, relatively large passageways are created between the part 23' of the first portion 23 and the inner surface of the sealing element 4, so that the inner pressure is vented, thereby leading to a characteristic "plop" sound.

Second Mode of the Invention

A second mode of the present invention will now be described in more detail with reference to FIGS. 17 to 23.

Stopper

Figure 17A:
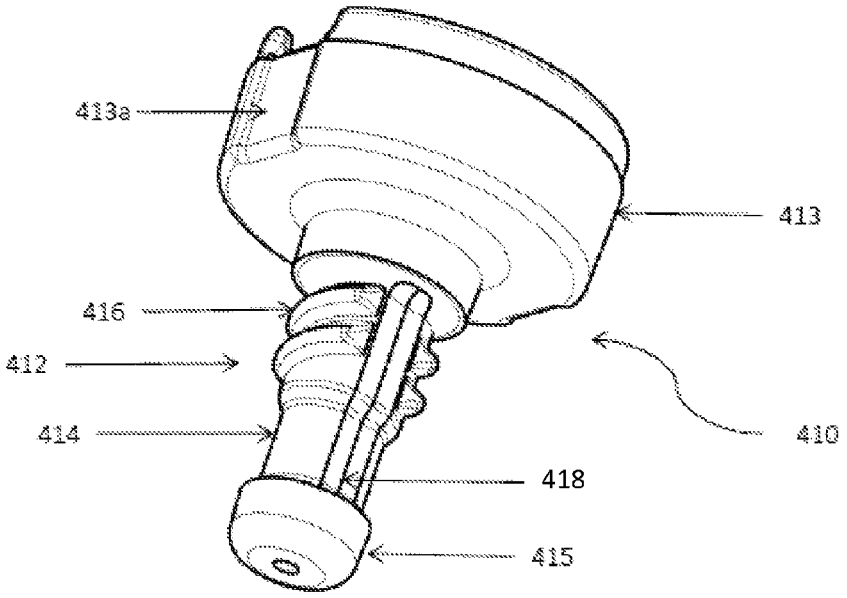
FIG. 17*a* shows a side view of the stopper according to a sixth embodiment.
Figure 17B:
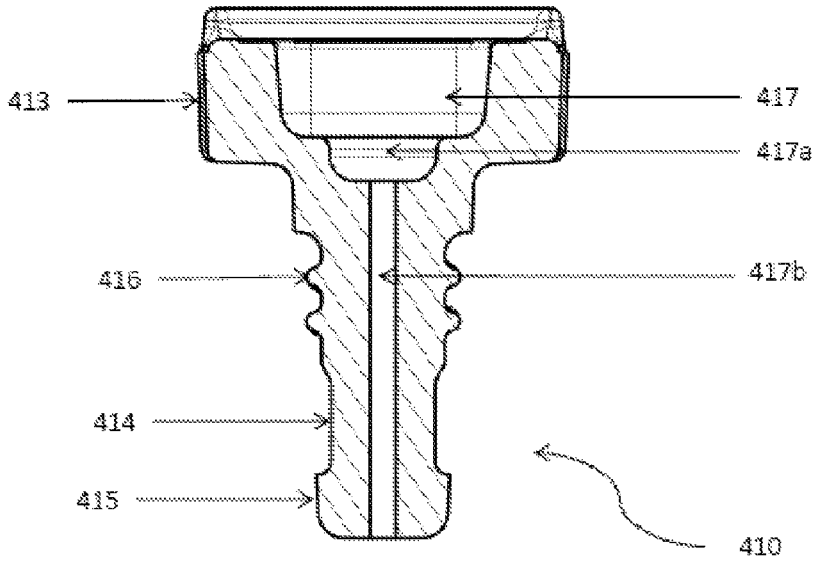
FIG. 17*b* shows a side view of the stopper according to the sixth embodiment.

FIGS. 17*a* and 17*b* show a cross sectional side view of a stopper 410 for a bottle according to a sixth embodiment of the invention. The stopper 410 comprises a stopper part 412 for introduction into a mouth of a bottle and a head part 413 joining the stopper part 412 via a neck portion. As apparent from FIGS. 17*a* and 17*b*, the stopper part 412 comprises, after the neck portion along the longitudinal axis of the stopper 410, a first portion 414 and a second portion 415, the first portion 414 being located above the second portion 415 along the longitudinal axis of the stopper 410. The first portion 414 has an essentially cylindrical shape, and the second portion 415 has a diameter that is larger than a diameter of the first portion 414.

The head part 413 of the stopper 410 and the neck portion may be defined as above with respect to the first mode of the invention. The dimensions of the stopper and the shape of the head part may be similar as described above with respect to the first mode of the invention. Likewise, the stopper part may comprise an interlocking mechanism, e.g. in the form of a screw thread 416 or a plurality of screw threads 416 extending parallel to each other, as described with respect to the first mode, which may extend less than a full circumference of the stopper portion 412, preferably on half a circumference of the stopper part 412.

In a preferred embodiment, as can be seen from FIGS. 17*a* and 17*b*, the difference of diameter at any two cross-section of points on the stopper part 412 is not more than 30%. Similarly the diameter of the first portion 414 is not less than 70% of the diameter of the second portion 415 of the stopper part 412. Furthermore, the diameter of the first portion 414 of the stopper part is not less than 60% of the diameter of the screw threads 416 on the stopper part 414. The advantages of providing a stopper part with a relatively uniform diameter have been explained earlier.

In the sixth embodiment of the invention as seen in FIG. 17*a*, the one or more screws threads are broken by two flat surfaces 418 which are formed on the longitudinal direction of the stopper, thereby leading to a breaking of the threading into two halves. This breaking is designed such that any parting lines are formed on the plane surface rather than on the threading. As it is known to a person skilled in the art, parting lines may be formed during the process of pressed glass manufacturing due to the use of two separate molds. The formation of these parting lines on the one or more screw threads may cause undesirable additional friction during rotation. Therefore, providing a plain surface where the parting lines are formed causes the screw threads to be free of parting lines and thus avoids undesirable friction.

Figure 20:
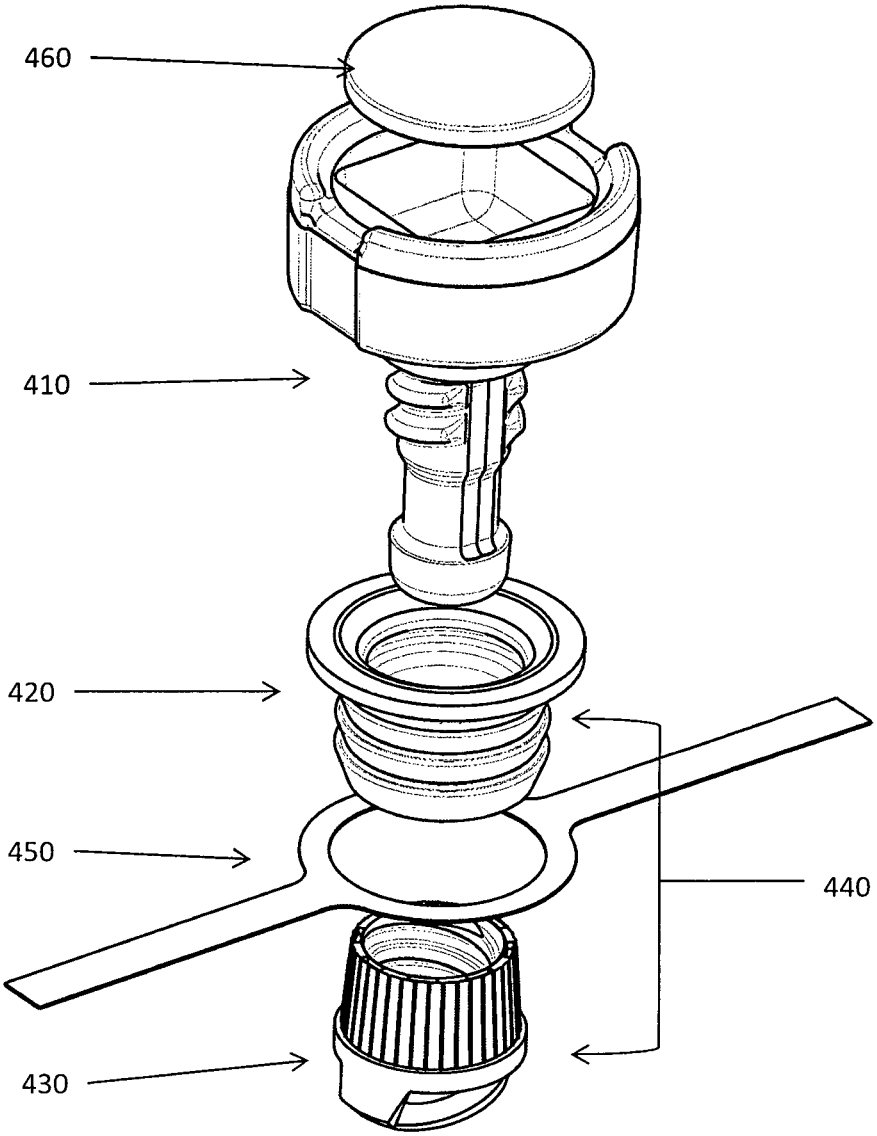
FIG. 20 shows an exploded view of the system comprising the stopper and the sealing element according to the sixth embodiment.

Similar to the embodiment provided in FIG. 2, the stopper 410 of the present embodiment represented in FIG. 20 comprises a pair of notches 413*a*, 413*b*. The notches are formed on a lateral surface of the head part 413 at diametrically opposed positions. The notches are provided to facilitate the holding of the head part with the fingers to allow rotating. In the sixth embodiment of the invention, the design of the head part is circular; however, it may differ from the above mentioned configuration to include other shapes and sizes, such as a polygon with multiple sides. The advantage of having a polygonal shaped head part is that it does not require additional notches for providing a holding grip.

The head part can also be provided with a storage cavity 417 as seen in FIG. 17*b*. This storage 417 cavity is designed such that it is capable of holding materials such as sheets with informational literature, or any other items used, e.g., for marketing purposes. The sheets can be made of paper, but are preferably made from a polymer, to tolerate deformation of the material such as folding and crumpling. The cavity provided on top of the head part has a polygonal cross section and preferably is a square or other rectangle. The depth of the storage cavity 417 is designed such that, for a given cross-section of the cavity, the volume of the cavity is maximized. In one embodiment, the depth of the storage cavity 417 is at least 50% of the height of the head part. In another embodiment, the depth of the storage cavity is at least 60% of the height of the head part. In yet another embodiment, the depth of the storage cavity is at least 70% of the height of the head part. These depths are selected such that there is a decent balance between providing the storage cavity with maximizing the storage volume, as well as avoiding making the corners on the head part unstable due to the lesser volume of material on the stopper due to the deeper cavity.

To maximize the volume of the cavity, the diagonal length of the cross-section of the cavity when viewed from the top is at least 70% of the length of a diagonal of the upper surface of the head part. This storage cavity is large enough to accommodate an object, such as a folded paper as described earlier, at least having a height of 5 mm and a length of 10 mm. Preferably, the storage cavity is large enough to store an object having a height of 7 mm and a length of 15 mm.

The dimensions of a square storage cavity 417 formed on the head portion are, e.g., 7.7 mm in height (depth) and 17.3 mm in width. The advantage of having a square cavity portion is that it is shaped to utilize efficiently the space to hold a folded sheet, and it also provides sufficient non-cavity area on the surface of the head part for an adhesive and therefore provides a better holding of a cover with the head part.

Preferably, the cavity is covered on the top to hold the materials placed inside the cavity by means of a cover 460. This cover could be in form of a coin such as a muselet, having a circular or other preferred shape to cover the cavity, or it can be in form of a tamper proof element 450. In order to accommodate the cover, the upper surface of the head part is provided with a recess having dimensions such that it can hold the cover on the upper surface without moving. This recess also provides a flush finish on the upper surface of the head part when the cover is placed. The cover is held on to the head part by an adhesive.

As it will be appreciated by the skilled person, the stopper with a storage cavity as described above can be implemented in any such closure system and not only for the closure systems as described above, where the stopper part comprises an interlocking mechanism for engaging with a counterpart interlocking mechanism of the sealing element, and where the interlocking mechanisms are configured to permit bringing the sealing element into an unsealed position by an unsealing action which comprises rotating the stopper with respect to the bottle. For example, the cavity can advantageously be used in combination with the prior art stopper as described in EP 1 456 092 B1.

Figure 21:
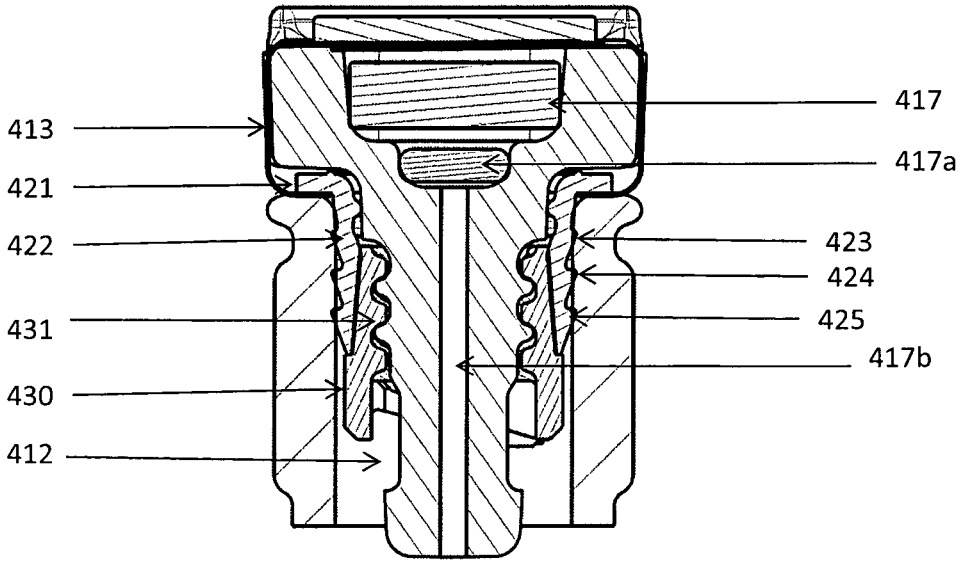
FIG. 21 shows a cross sectional side view of the stopper for the bottle according to the sixth embodiment with the sealing element according to an embodiment in the sealed position.
Figure 22:
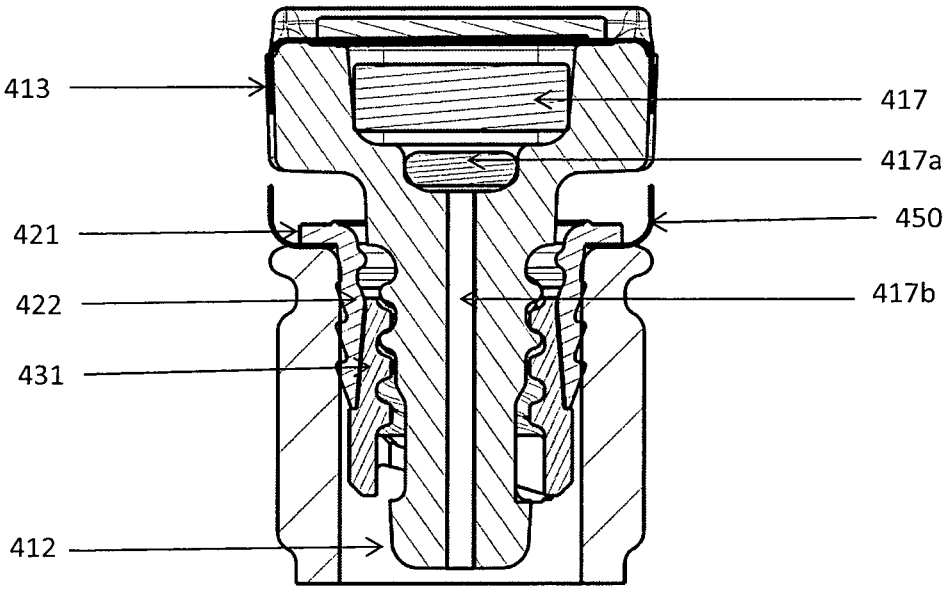
FIG. 22 shows a cross sectional side view of the stopper for the bottle according to the sixth embodiment with the sealing element according to an embodiment in a partially un-sealed position.
Figure 23:
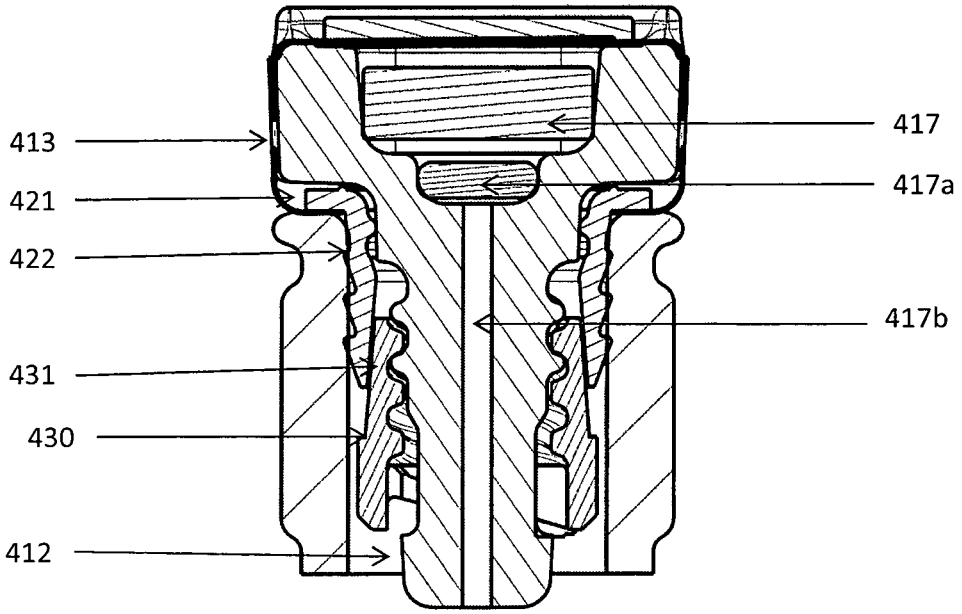
FIG. 23 shows a cross sectional side view of the stopper for the bottle according to the sixth embodiment with the sealing element according to an embodiment in the unsealed position.
Figure 24A:
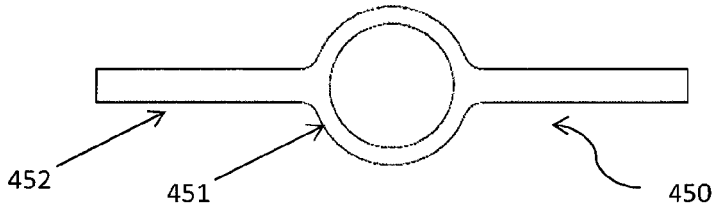
FIG. 24*a* shows a top view of the tamper proof element with the preferred embodiment having two strips, for sealing the closure system according to the present invention.
Figure 24B:
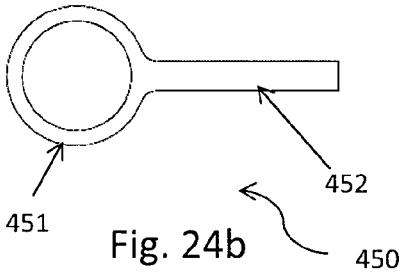
FIG. 24*b*-24*e* shows a top view of tamper proof element with one, three, four and five strips respectively, for sealing the closure system according to the present invention.
Figure 24C:
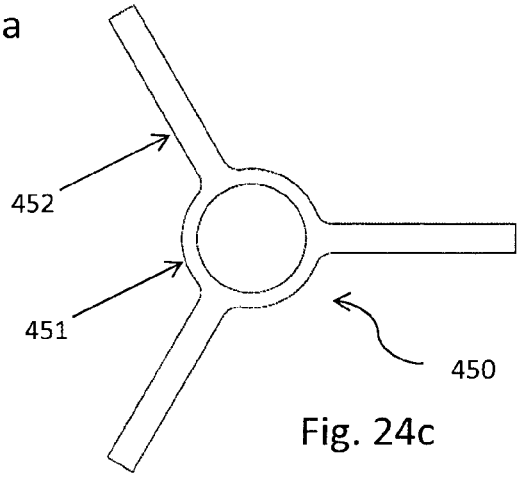
Figure 24D:
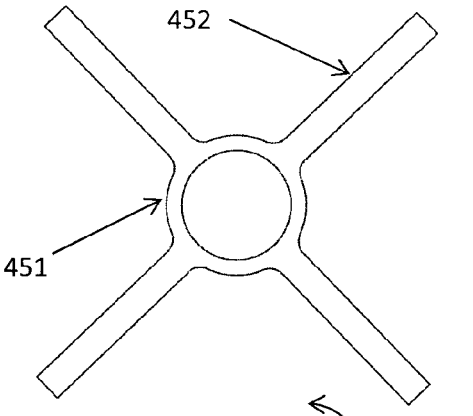
Figure 24E:
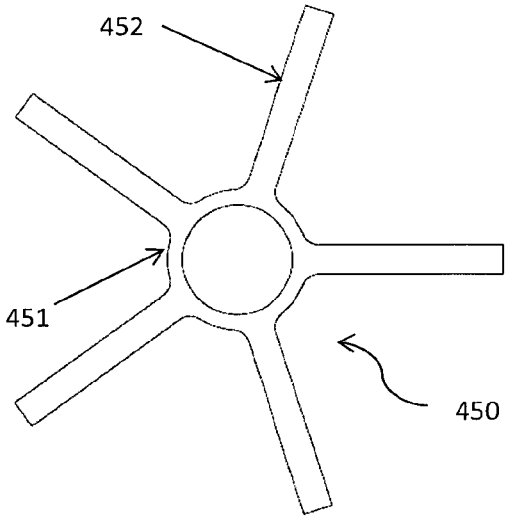

The stopper 410 of the present embodiment may also contain a cavity extending in the longitudinal direction into the stopper 412, similar to that one provided in the first and second embodiments of FIGS. 3 and 4, instead of or in addition to the cavity on the head part. This longitudinal cavity 417*b* as illustrated in FIGS. 21 to 23 opens out at the tip of the stopper. This longitudinal cavity 417*b* opens out at the top to a filter cavity 417*a* which has a diameter larger than the diameter of the longitudinal cavity.

The filter cavity 417*a* is used for accommodating a filter made of a material that is both liquid-impermeable and air-permeable to a certain extent. Such a filter can be manufactured, for instance, out of the Saranex™ material produced by Dow Chemicals, to name only one possible material. The filter is hermetically arranged at the bottom of the longitudinal cavity 27 in direct contact with the opening 28, which allows for controlling the amount of oxygen that can penetrate into the wine bottle. By doing so, the maturing process of a wine can be controlled.

In the preferred embodiment, and as seen in FIG. 17*b*, the diameter of the longitudinal cavity 417*b* at a given cross-section is not greater than 30% of the diameter of the stopper part. This is in order to provide a small opening for air to reach the filter and maturity measurement. Too large an opening might provide too much air and also weaken the stopper due to the hollow cavity.

As it will be appreciated by the skilled person, the stopper with a longitudinal cavity and filter cavity as described above can be implemented in any such closure system and not only for the closure systems as described above, where the stopper part comprises an interlocking mechanism for engaging with a counterpart interlocking mechanism of the sealing element, and where the interlocking mechanisms are configured to permit bringing the sealing element into an unsealed position by an unsealing action which comprises rotating the stopper with respect to the bottle. For example, the cavities can advantageously be used in combination with the prior art stopper as described in EP 1 456 092 B1.

In addition to the cavity, an opening may also be provided to the stopper 410, similar to that as described in second embodiment of FIG. 4. In addition to the above, a skilled person may also provide channels on the stopper of the present embodiment in accordance with the description provided in the fourth embodiment described in FIG. 13.

According to the sixth embodiment of the invention as shown in FIG. 20, a sealing element 440 for sealing a stopper for a bottle, preferably a beverage bottle, like a wine bottle is described. The sealing element 440 is separate from the bottle, i.e. it does not form part of the bottle, nor is it attached to the bottle.

Sealing Element

According to the sixth embodiment of the invention, the sealing element comprises at least two different components. In the exemplary embodiment represented with respect to FIG. 20, the sealing element 440 is made of a first component 430 and a second component 420. The advantage of providing different components is that each component can comply with different specifications. It is possible to have different components specifically designed to perform different functions, thereby overcoming limitations of many single components. For example, the two components can be made of different materials having different frictional coefficients. Furthermore, the components can be designed to interface with the different parts of the stopper or mouth of the bottle as required. In the sixth embodiment, the first component 430 of the sealing element, which interfaces the stopper part 412 and carries the interlocking means 435 of the sealing element 440, is designed of a material like plastic, which has a relatively low friction coefficient and is relatively hard, so it engages well with the interlocking means 416 on the stopper part 412 and facilitates easier movement of the stopper during sealing and unsealing action as it will be explained later. On the other hand, the second component 420, which is in contact with the inner wall of the mouth of the bottle, and which performs the sealing function, has a relatively high friction coefficient and is relatively flexible.

Because in the sixth embodiment, as will be described below, the first component is located at least partially inside the second component, the first component of the sealing element in this embodiment of the second mode will be called the "inner component", and the second component of the sealing element will be called the "outer component". However, other configurations are possible, in which the second component is located, e.g., above the first component, and sealing is performed by the first component moving up and thereby compressing the second component in longitudinal direction of the stopper, and thus pressing the second component against the inner wall of the mouth of the bottle.

Outer Component of the Sealing Element

FIG. 18 shows the outer component 420 of the sealing element. This outer component 420 is formed such that the stopper part 412 of the stopper 410 with the inner component of the sealing element on it can be introduced into it. It comprises a sealing part 422 for sealing the stopper part 412 of the stopper 410 against the inner wall of the mouth of the bottle in the sealed position. This sealing part 422 may essentially have the shape of a ring or a tube.

The outer component 420 of the sealing element preferably further comprises an upper part 421 joining the sealing part 422. The upper part 421 provides sealing of the head part 413 against the mouth of the bottle in the sealed position. It extends essentially perpendicularly to the sealing part 422 of the outer component 420. This allows for a particularly secure and reliable sealing of the mouth of the bottle. Furthermore, in this embodiment, the head part 413 of the stopper does not come into direct contact with the top of the mouth of the bottle, preventing the stopper or the bottle to be broken or damaged when the stopper is introduced into the mouth of the bottle with some force. Finally, this embodiment also helps to prevent that the sealing element 440 slips (deeper) into the mouth of the bottle when the stopper is introduced into the mouth and prevents damages during transport. However, the upper part 421 exerts frictional force in the radial direction between the lower surface of the head part and the upper surface of the mouth of the bottle. A higher frictional force in the radial direction between the head part and the sealing element when compared to the frictional force between the sealing element and the glass bottle results in rotating the sealing element with the stopper, thereby causing spinning the sealing element in the bottle. Such spinning of the sealing element in the bottle makes it difficult to open the bottle by rotation. In order to avoid this high frictional force on the upper surface, a means for reducing the rotational friction between the head part of the stopper and the upper surface of the upper part of the sealing element is provided. This means for reducing the rotational friction between the head part of the stopper and the upper surface of the upper part of the sealing element in a preferred embodiment is a rim 427 which is provided on the upper surface of the upper part of the sealing element. This rim 427 is formed as a continuous circle thereby reducing the area of contact to the head part and thereby reducing the rotational friction between the head part of the stopper and the upper part of the sealing element.

The outer component 420 of the sealing element is made of a relatively flexible material such as plastic or rubber. Preferably, a shape memory material having flexible material may be chosen, which enables a deformation of at least parts (e.g. the sealing part 422) of the outer component 420 in the sealed position and a decompression of at least parts (e.g. the sealing part 422) of the outer component in the unsealed position such that the outer component springs back into its original shape, i.e. the shape it had prior to compression, upon bringing the sealing element into the unsealed position.

The outer component 420 of the sealing element 440, according to this embodiment of the invention has an essentially cylindrically shaped ring having openings at both its top and bottom ends. The opening on the bottom of the sealing element has a diameter which is essentially identical to the diameter of the opening on the top of the sealing element. At the most, the diameter of the opening in the bottom of the sealing element varies from the diameter of the opening on the top of the sealing element by 20%, as illustrated in the cross-sectional view as seen in FIG. 18. As it will be described later, a somewhat larger diameter on the bottom end as compared to the top end can facilitate the inner component of the sealing element to achieve the sealed position. The circular openings provided on each end of the sealing element 4 to allows the inner component 430 of the sealing element and the stopper part of the stopper to pass through them.

The dimensions of the outer component contribute to the design of the overall size of the sealing element in relation with the size of the stopper. In general, it is advantageous to provide a sealing element with an outer component having a size which is relatively smaller than the stopper part, for the reasons discussed above.

In a preferred embodiment, the smaller outer component of the sealing element is achieved the outer component having a length which is not greater than essentially half of the length of the stopper part, as seen in the embodiment illustrated in FIG. 20.

When considering the length of the outer component 420 of the sealing element with respect to the diameter of the outer component 420, it can be seen that in the embodiment illustrated in FIG. 18, the length of the sealing element is not greater than the outside diameter of the sealing element. As to be understood by the person skilled the art from the figures, the outside diameter of the outer component 420 of the sealing element 440 is essentially the same as the inner diameter of the mouth of the bottle. Therefore, having the length of the outer component of the sealing element equal to or not greater than 120% of the outer diameter of the sealing element also results in a smaller length of the sealing element compared to the stopper.

The outer component 420 of the sealing element 440 preferably comprises ribs which are formed in an outer portion of the sealing part 422. In the sixth embodiment of the invention, three adjacent ribs 423, 424, 425 are provided. The adjacent ribs 423, 424, 425 are formed, dimensioned and arranged in such a manner that they can be pressed against the inner wall of the mouth of the bottle.

Upon being pressed against the inner wall of the mouth of the bottle, an under-pressure or suction force is formed in one or more areas between the ribs on the sealing part and the inner wall of the mouth. This creates a particularly secure and reliable adherence of the sealing element on the inner wall of the bottle and ensures a particularly secure and reliable sealing of the bottle. Preferably, the ribs have a substantially saw tooth cross section, as seen in FIG. 18. This provides a smaller diameter of entry into the mouth of the bottle, thereby allowing easier insertion into the bottle.

Preferably, the inner wall of the outer component 420 of the sealing element has a sealing region 426, which in the present invention is preferably at least one grove. The groove runs along the entire circumference of the inner wall to form a lip 426 and is positioned such that it can accommodate the neck portion of the stopper 410 to provide a further sealing between the outer component 420 and the stopper 410. The sealing region is preferably placed on the upper side of the second component 420 of sealing element.

Inner Component of the Sealing Element

The inner component 430 of the sealing element is shown in FIG. 19 (in a bigger scale than the outer component of FIG. 18). It carries the interlocking means 435 of the sealing element 440 and contains a spreading element which is used for spreading the outer component 420 of the sealing element against the inner wall of the mouth of the bottle.

The spreading element of the inner component 430 in accordance with the sixth embodiment is essentially a cylindrical shaped nut which is formed such that it can be at least partially introduced between the outer component 420 of the sealing element 440 and the stopper part 412.

The inner component of the sealing element 430 is preferably made of a hard and firm material having low elasticity, such as plastic, wood, glass or other such materials. In principle, any firm material may be chosen which undergoes low compression in the sealed position, and preferably remains in its original shape during and after sealing.

The inner wall of the inner component 430 comprises an interlocking mechanism in the form of a screw thread, or several (preferably two) screw threads 435 extending parallel to each other. The screw thread 435 or the plurality of screw threads 435 arranged on the inner wall of the inner component 430 is formed and dimensioned in such a manner that it corresponds to the screw thread 416 or the plurality of screw threads 416 of the stopper part 410. The screw threads on the inner component 430 and the corresponding stopper part 412 should be made such that spacing between them is exactly adequate for interlocking, thereby ensuring a low tolerance between them. Preferably, a locking means is provided on the upper end of the screw threads of the inner component 430 which ensures that the inner component is not entirely screwed out of the screw thread of the stopper.

Preferably, the outer surface of the inner component 430 is divided into two portions, an upper portion 431 and a lower portion 432. The outer surface of the upper portion 431 has a diameter increasing from the top towards the bottom and thereby forming a spreading element. As can be seen in FIG. 19, the cross-section of the upper portion 431 of the inner component 430 of the sealing element 440 has a conical shape.

Preferably, the upper portion 431 is separated from the lower portion 432 by a protrusion 433 along the circumference of the inner component 430. This protrusion 433 forms the upper end of the lower portion 432. Therefore, in the border region between the lower portion 432 and the upper portion 431, the lower portion 432 has a relatively larger diameter than the upper portion 431. The protrusion 433 is provided such that, when the inner component 430 is introduced between the outer component 420 and the stopper part 412, the protrusion 433 ensures that the outer component 420 is held on the inner component 430 and does not slip away into the bottle.

The outer surface of the upper portion preferably contains a gripping means 436, to provide additional frictional force between the inner component and the outer component, the purpose of which will be explained later in the description.

Preferably, the lower portion 432 of the inner component comprises a spring 437 formed by two circular flanges with partial spiral windings. These springs have an inner circular diameter smaller than the second portion of the stopper to ensure that the inner component does not come off the stopper part 412. This also ensures that even when the stopper is screwed with force, it does not affect the interlocking mechanism on the stopper and the inner component since the spring dampens the force exerted on the inner component. When the spring is in contact with the second portion 415 of the stopper, it pushes the inner component in the upward direction thereby ensuring that the inner component is screwed back to the interlocking mechanism of the stopper. The springs 437 are connected to the lower portion 432 by means of a breakpoint means 438 which break when the inner component is assembled onto the stopper. The lower end of the lower portion 432 of the first component is tapered to enable easy introduction of an assembled system having the stopper and the sealing element into the mouth of the bottle.

Sealed Position

FIG. 21 is a sectional view of the stopper 410, the outer component 420 of the sealing element and the inner component 430 of the sealing element, according to the sixth embodiment of the present invention in the sealed position in the mouth of the bottle. In this position, the inner component 430 of the sealing element is partially inside the outer component 420 of the sealing element, to such an extent that it presses the outer component against the inner wall of the mouth of the bottle. Specifically, as seen in FIG. 21, the upper portion 431 of the inner component 430 presses the sealing part 422 of the outer component 420 of the sealing element 440 against the inner wall of the mouth of the bottle. As described earlier, the upper portion 431 which forms a spreading element has an increasing diameter, thereby forming a conical shape. To accommodate the conically shaped spreading element, the outer component also has a conical inner shape. This is provided in order to uniformly spread the outer component against the mouth of the bottle, in order to achieve sealed position. The conical inner shape of the outer component also facilitates entering of the inner component into the outer component.

The pressing force is achieved by an appropriate selection of the dimensions of at least parts (e.g. the upper portion 431) of the inner component 430 and at least parts (e.g. the sealing part 422) of the sealing element 420 with respect to the inner diameter of the mouth of the bottle. For example, the thickness of (parts of) the outer component 420 of the sealing element 440 is selected such that it is greater than the difference between the radius of the inner wall of the mouth of the bottle and the radius of (parts of) the inner component 430. As a consequence, at least parts of the outer component 420 of the sealing element are compressed in the sealed position.

In the various embodiments of the present invention described herein, the dimensions of the stopper part 412, the inner component 430 and the sealing part 422 with respect to the diameter of the bottle mouth are selected in such a manner that the force that is exerted on the inner wall of the bottle is sufficiently large to hold the stopper in an axial and radial direction in the sealed position. Preferably, the dimensions of the stopper, inner component 430 and the sealing part with respect to the diameter of the bottle mouth are selected in such a manner that the force exerted on the inner wall of the bottle is sufficiently high to eliminate the need for any additional fixing element, for example a fixing element attached to the bottle body, for fixing the stopper during transport of the bottle or during storage in a horizontal position.

As described earlier, the upper portion 431 of the inner component 430 has an increasing diameter and presses the sealing part 422 against the inner wall of the mouth of the bottle. The adjacent ribs 423, 424 and 425 arranged on the sealing part 422 of the outer component 420 are forced against the inner wall of the bottle by the upper portion 431 of the inner component 430. The shape memory capable flexible material of the outer component 420 ensures that the ribs have the tendency to go back to their original shape, thereby building up an under-pressure or suction force in one or more areas between the sealing part and the inner wall of the mouth of the bottle. This under-pressure or suction force enables a particularly secure and reliable adherence of the sealing element 420 with the inner wall of the mouth of the bottle. Further in accordance with the sixth embodiment of the invention, lip 426 on the inner wall of the outer component of the sealing element 420 preferably engages with the neck portion of the stopper 410 to provide further sealing.

As illustrated in FIG. 21, in the sealed position the sealing part is located on an upper end of the stopper. That is, the sealing part 422 is located at a height of the upper 60% of the stopper part. In another embodiment, the sealing part 42 is located at a height of the upper 50% of the stopper part. In yet another embodiment, the sealing part 422 is located at a height of up of 30% of the stopper.

Providing the sealing part 422 on the upper end of the stopper is advantageous for the reasons discussed above.

Unsealed Position

FIG. 23 is a sectional view showing the stopper 410, the inner component 430 and the outer component 420 according to the sixth embodiment of the present invention in an unsealed position during the process of opening the bottle. As can be seen in FIG. 23, the lower part of the upper portion 431 of the inner component 430 does not press the sealing part 422 of the outer component 420 of the sealing element towards the inner wall of the mouth of the bottle. Furthermore, the screw treads 416 on the stopper part 412 are not completely screwed with the corresponding threads 435 of the inner component 430. Therefore, the stopper 410 protrudes from the inner and outer component of the sealing element and the mouth of the bottle.

Since the upper part of the upper portion 431 of the inner component 430 has a reduced diameter compared to the diameter of the lower part of the upper portion 431, the pressure exerted on the sealing part 422 having the adjacent ribs 423, 424 and 425 is lesser than the pressure which was exerted by the lower part of the upper portion 431 of the inner component 430 in the sealed position. As a result of a reduced pressure on the outer component 420, the sealing part 422 retracts from the compressed (sealed) position shown in FIG. 21 to the unsealed position shown in FIG. 23.

Although part of the upper portion 431 of the inner component 430 is under the sealing part 422 of the outer component 420, there is hardly any pressure exerted on the sealing part. This is because the sealing part 422 is not entirely in contact with the inner component 430, (i.e. the upper end of the sealing part 422 is not in contact with the inner component, and the lower end of the upper portion 431 of the inner component 430 is not in contact with the sealing element).

As mentioned earlier, the stopper part 412 has a second portion 415 below the first part 414, the diameter of which is larger than the diameter of the stopper part 412. This larger diameter of the second portion 415 ensures that when pulling the stopper 410 out of the mouth of the bottle, the outer component 420 and the inner component 430 of the sealing element 440 are retained on the stopper part 412. As seen in FIG. 23, the lower portion of the inner component 430 abuts at the junction between the first section 414 and the second section 415.

Unsealing Action

It will now be explained in detail how the sealing element can be brought by the user from the sealed position shown in FIG. 21 to the unsealed position shown in FIG. 23. The "unsealing action" as described herein does not include removal of any external packing, such as shrink-wraps or any outer covers placed on the stopper. The unsealing action comprises only the necessary steps intended to remove the stopper from the mouth of the bottle in accordance with the present invention. According to the present embodiment, the unsealing action starts with rotating the stopper with respect to the bottle, for unscrewing it. The user places his fingers on the head part 413 of the stopper 410, preferably on notches 413*a*, 413*b* of the head part 413, and exerts a rotating force on the stopper about the longitudinal axis of the stopper. While doing so, the bottle is held firmly by the user so that only the stopper is rotated, and not the bottle.

In the sealed position, the sealing part 422 of the outer component 420 is pressed against the wall of the bottle, thereby producing high frictional force. Therefore, the outer component 420 of the sealing element remains in place while the stopper part 412 is rotated with respect to the bottle. Also the inner component 430 of the sealing element remains in place because a gripping means 436 is provided on the outer surface of the upper portion 431 of the inner component 430, which provides a friction in the rotating direction, so that the outer component of the sealing element holds the inner component in rotational direction during rotation of the stopper.

The outer component 420 of the sealing element is made of materials having higher frictional coefficient than the materials of the inner component 430. The frictional force exerted by the sealing part 422 against the inner wall of the mouth of the bottle is also governed by the design of its outer surface. Especially the adjacent ribs 423, 424 and 425 provided on the sealing part 422, when compressed, provide an under-pressure or suction force against the inner wall of the mouth of the bottle.

The screw thread 416 on the stopper part 412 interacts with the corresponding screw threads 435 on the inner wall of the inner component 430. This interaction will have the effect that the stopper part is unscrewed and moves up, away from the top of the mouth of the bottle and the sealing element 440, which is retained in the sealed position due to high frictional and gripping force. This movement of the stopper away from the top of the mouth and the sealing element 440 introduces a space between the head part 413 of the stopper and the mouth of the bottle and the sealing element 440, as can be seen in FIG. 22.

The unscrewing of the stopper, away from the inner and outer component, has the effect that the neck portion of the stopper is not in contact with the lip 426 of the outer component of the sealing element any more, thereby already slightly releasing the frictional or adhesive force between the outer component 430 of the sealing element 440 and the inner wall of the mouth of the bottle. However, it is still strong enough to firmly hold the sealing element 440 in the mouth of the bottle (and indirectly—through the screw threads 416, 435—also the stopper). Therefore, in FIG. 22, the sealing element is still in an at least partially sealed position.

In accordance with the present embodiment of the invention, after unscrewing the stopper 410 as described above, the user pushes the stopper back into the mouth of the bottle. Since the screw threads provided on the stopper part 412 and the inner component 430 of the sealing element provide an interlocking hold, the extent of the push administered on the stopper is transferred onto the inner component 430, thereby pushing it to similar extent into the mouth of the bottle.

While the inner component 430 of the sealing element is pushed into the mouth of the bottle, the outer component 420 remains fix. Therefore, the inner component 430 is partially moved out of the outer component 420 of the sealing element, so that after the push, only the upper part of the upper portion of the inner component is pressing the sealing part 422 against the mouth of the bottle. This results in the inner component 430 applying less pressure on the sealing part 422, therefore reducing the frictional or adhesive force applied by the sealing part 422 on the inner wall of the mouth of the bottle. The release of the pressure is further increased by the fact that, as described earlier, the upper part of the upper portion of the inner component, which after pushing remains inside the outer component of the sealing element, has a smaller diameter than the lower part. All this has the effect that the push results in bringing the sealing element from the at least partially sealed position represented in FIG. 22 to the unsealed position represented in FIG. 23.

Consequently, by unscrewing the stopper followed by a push of the stopper into the bottle, the user can bring the sealing element from the sealed position represented in FIG. 21 to the unsealed position represented in FIG. 23.

As outlined above, in the position represented in FIG. 23, the end of the sealing element abuts at the junction between the first portion 414 and the second portion 415 of the stopper part 412, due to the difference of diameter between the spring 437 of the sealing element 440 and the second portion 415 of the stopper part 412. In order to completely open the bottle, the user only needs to pull the stopper out of the bottle after unsealing. His pulling force will allow for removing any remaining adherence of the sealing part to the inner wall of the bottle, caused, e.g., by the adjacent ribs. Consequently, the whole system comprising the stopper 410 and the sealing element 440 can be easily removed from the mouth of the bottle.

In case the outer component 420 contains only the sealing part 422, a vertical movement made on the stopper might push the outer component further into the mouth of the bottle, due to the absence of an upper part 421. However, it is not moved to the same extent as the inner component, due to the higher frictional force between the sealing part 422 and the mouth of the bottle compared to the frictional force between the inner component 430 and the outer component 420. Therefore, release of pressure may be smaller, and there may still be some frictional force between the mouth of the bottle and the outer component 420. In such a case, the glass stopper 410 is then wriggled out to a certain extend and again pushed into the mouth of the bottle. This repeated action of wriggling the stopper 410 and pushing it in leads to a release of under-pressure between the ribs and the inner wall of bottle, therefore reducing the frictional force and enabling removing of the stopper from the bottle.

Resealing Action

In order to reseal the bottle, the user simply puts the stopper 410 along with the sealing element 440 back into the mouth of the bottle until the sealing element (440) is inside the mouth of the bottle and the upper part 421 of the outer component touches the mouth of the bottle. The user then rotates the stopper in the opposite direction as for opening. The spring 437 on the inner component 430 of the sealing element pushes the inner component 430 up, thereby enabling engagement of the screw threads 435 of the inner component 430 with the threads 416 of the stopper part 412, in case engagement was lost. The rotation allows for screwing back the stopper part 412 onto the screw thread 435 of the inner component 430. In accordance with the sixth embodiment, this rotation will lead to the inner component 430 moving up, towards the head part 413 of the stopper, thereby moving inside the outer component 420 along the stopper part 412. When being reintroduced into the outer component, the increasing diameter of the upper portion of the inner component 430 results in pressing the sealing part back against the wall of the mouth of the bottle. The protrusion 433 on the inner component 430 ensures that the outer component 420 stays on top of the inner component and does not slide over it.

Tamper Proof Element for a Closure System of the Present Invention

In another embodiment of the invention, a tamper proof element for the closure system of the present invention is provided. When the system is in a fully assembled state, this tamper proof element allows the user to find out whether the stopper has been moved, in an axial direction and/or in a radial direction with respect to the sealing element. That is, the tamper proof element allows the user to find out whether the stopper has been rotated with respect to the sealing element, whereby in the preferred embodiments the stopper also moves upwards with respect to the sealing element, or if the stopper has been pulled away from the sealing element. The tamper proof element is connected to the stopper on the one hand and is connected to the sealing element on the other hand, in such a way that, in case the stopper is moved with respect to the sealing element from its fully assembled state, the tamper proof element is broken.

This connection between the tamper proof element and the stopper can be made by either one of or combination of an interlocking connection or a frictional connection or an adhesive connection in the radial and/or axial direction. Similarly, the connection between the tamper proof element and the sealing element can be made by either one of or combination of an interlocking connection or a frictional connection or an adhesive connection in the radial and/or axial direction.

Multiple types of connections are provided for both connections; thereby it provides a foolproof tamper proof element which performs it function even if one type of connection fails. Furthermore since different types of connections a possible, a simpler and cheaper type of connection can be utilized for the tamper proof element in order to reduce bottling costs.

FIG. 24*a* to 24*e* show a tamper proof element according to a preferred implementation of the tamper proof element.

The tamper proof element 450 comprises a ring 451 as illustrated in the FIGS. 24*a* to 24*e*. In a preferred embodiment, the ring is round. However, as it can be seen by the person skilled in the art, the ring may be implemented in other shapes such as a polygon or a hexagon.

In the preferred embodiment of the ring being round ring, the inner diameter of the ring 451 is greater than to the outer diameter of the sealing element 440. This inner diameter is provided such that it is possible for the sealing part of the sealing element to penetrate the ring as will be explained later. Similarly, the outer diameter of the ring is not greater than the outer diameter of the stopper. This outer diameter is provided such that the ring of the tamper proof element stays underneath the head part of the stopper when the stopper part is introduced through the ring 451 of the tamper proof element. This forms at least an interlocking connection in the axial direction and a frictional connection in the radial direction.

The tamper proof element 450 further comprises one or more strips 452 connected to and extending to the outside of the ring. In the preferred embodiment, the tamperproof element 450 comprises two strips 452*a* and 452*b*. The strips have a length such that they can be connected with the head part of the stopper.

Figure 25A:
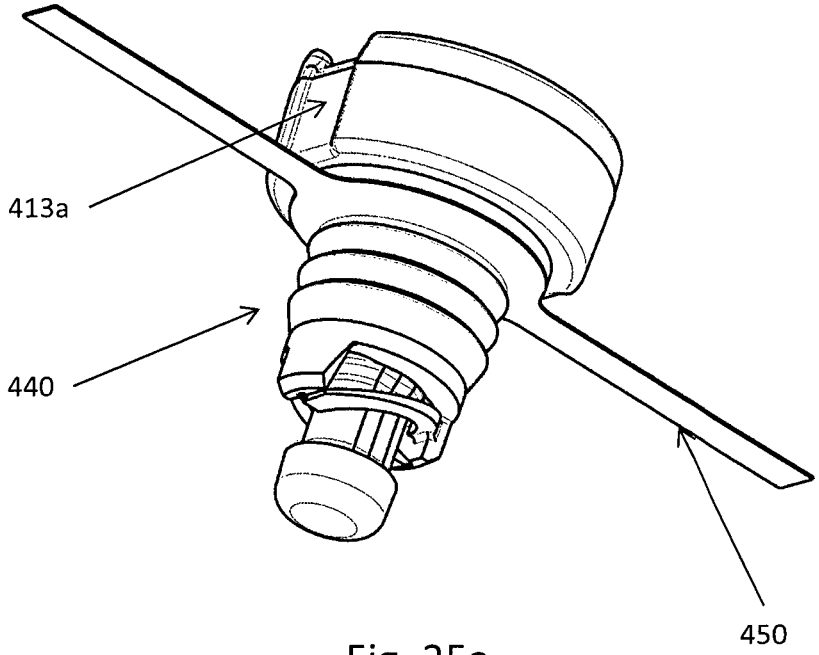
FIG. 25*a* shows an isometric view of the fully assembled closure system with an uninstalled tamper proof element.

FIG. 25*a* illustrates the tamper proof element 450 connected to the sealing element. The ring 451 of the tamperproof element is located on the stopper part of the stopper below the upper part of the sealing element. Since the diameter of the ring is smaller than the upper part of the sealing element, the tamperproof element 450 stays interconnected to the sealing element 440 when the sealing element is placed through the ring 451. This forms an interlocking connection between the tamperproof element 450 and the sealing element 440. However, additional connection might be provided between the tamper proof element and the sealing element such as an adhesive to provide an adhesive connection.

Figure 25B:
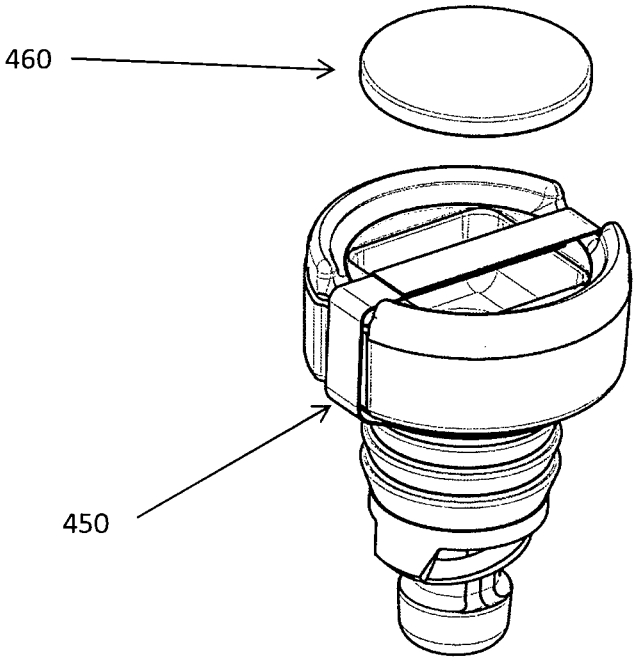
FIG. 25*b* shows an isometric view of the fully assembled closure system with the tamper proof element installed but before placing a cover.

FIG. 25*b* illustrates how the tamper proof element 450 is connected to the stopper 410. As seen in the figure, when the system is fully assembled, the strips 452*a*, 452*b* are wrapped around the lateral surface on the notch 413*a*, 413*b* of the head part 413 of the stopper 410 all the way to the upper surface of the head part 413 of the stopper. The notches on the sides provide additional interlocking and frictional connection between the tamperproof element and the head portion of the stopper in radial direction. The ends of the strips which meet on the upper surface are joined together and glued by means of an adhesive, thereby forming an interlocking connection with the head part of the stopper in axial direction. As a person skilled in the art will understand, the ends of the strip may be not joined together, and therefore they can also be glued either onto the lateral surface or onto the upper surface of the stopper, depending on the length of the strip, thereby forming an adhesive connection with the head part of the stopper.

Figure 25C:
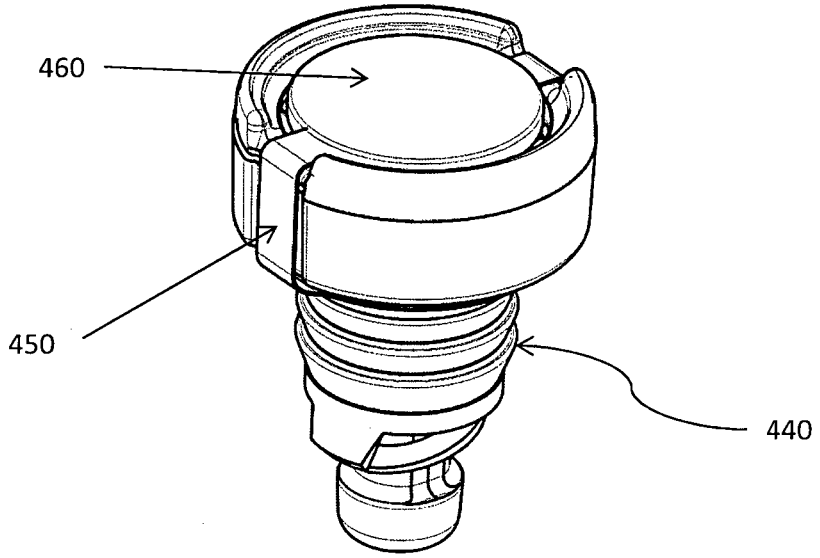
FIG. 25*c* shows an isometric view of the fully assembled closure system with the tamper proof element installed and a cover placed on the head part.

Alternatively, the strips may also be merely wrapped onto the upper surface of the head portion and covered by means of a cover 460, which is then glued on the upper surface. In this case, the cover 460 becomes a part of tamper proof element. In other words, the tamper proof element can comprise more than one element. FIG. 25*c* illustrates a fully assembled system with the tamper proof element 450 and the cover 460.

The tamper proof element is preferably made from thin materials such as aluminium sheet or a tin foil material or plastic, such that it is soft enough to be broken easily when opening, but hard enough to withstand normal wear and tear during transportation.

Figure 25D:
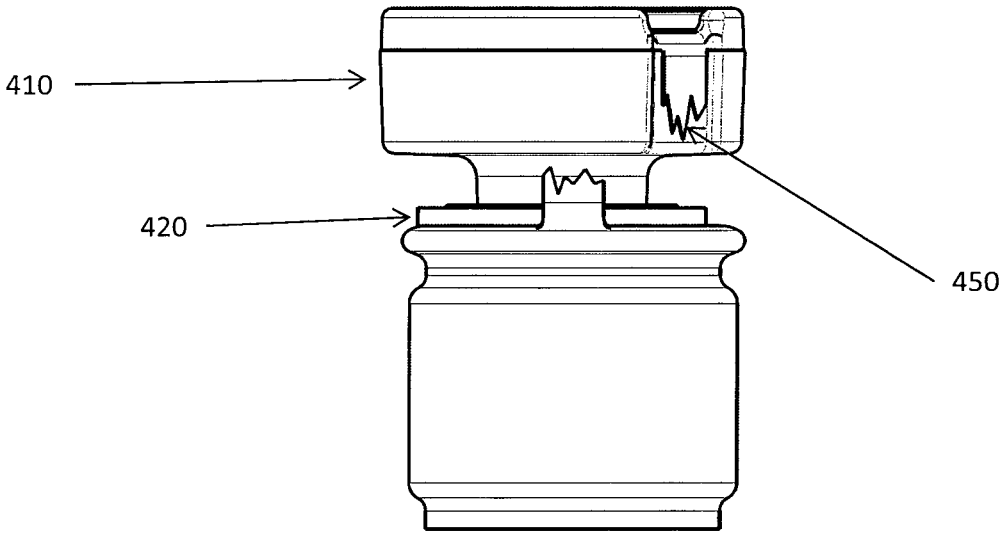
FIG. 25*d* shows an isometric view of the fully assembled system with the tamper proof element broken when the stopper is rotated.

As illustrated in FIG. 25*d*, the tamper proof element which is connected to the fully assembled system is broken when the stopper is rotated in comparison to the sealing element. This broken tamperproof element helps the user to find out whether the stopper has been moved in relation to the sealing element, thereby signifying that the closure system has been opened from the sealed bottle.

Bottling

It will now be explained how a bottle is initially sealed using the closure system according to the sixth embodiment of the present invention. First, the inner component 430 of the sealing element is introduced into the sealing part 422 of the outer component 420, such that the inner component is at least partially inside the outer component 420. The combined sealing element 440 is then introduced onto the stopper part 412 of a stopper 410 by screwing the sealing element 440 onto the stopper. The lower end of the inner component 430 comprises an assembly grip 434 as seen in FIG. 19, which allows an assembly unit to screw the sealing element 440 onto the stopper, preferably all the way up. At this stage, the closure system is fully assembled, such that the stopper and the sealing element are in the same configuration as in the sealed position, however not yet bottled. In particular, in the fully assembled state, the sealing element is expanded, so that when the stopper with the sealing element assembled onto it is pushed into the bottle, the sealed position is reached without the need to rotate the stopper. Furthermore, in the fully assembled state, the outer component is expanded when the inner component is introduced, and in this stretched state it is shipped for bottling. This pre-expanded stretched system allows for easier bottling since the stress on the stretched component is less.

The tamperproof element is then introduced to the fully assembled system such that the system passes through the ring of the tamperproof element. The strips of the tamperproof element are then wrapped around the head portion as described earlier, and the cover is placed on the upper surface of the head portion.

The fully assembled system with the stopper part 412 and the sealing element 440 along with the tamper proof element 450 arranged thereon is then introduced into the mouth of the bottle and pressed until the sealed position is reached. Since the fully assembled closure system according to this invention can simply be pressed into the bottle during the bottling process without the need to perform any other action, it allows for a faster and simpler bottling.

Preferably, the stopper part 412 along with the sealing element 440 is introduced into the bottle by first dropping the stopper into the mouth of the bottle and then pushing it. To ensure that during dropping the stopper lands in an upright longitudinal position in the mouth of the bottle, the stopper is designed to be in equilibrium when subjected to gravity. This equilibrium is achieved by designing the second portion 415 to have adequate volume and mass, by means of having an optimal length and diameter in comparison to other portions of the stopper, and by considering the material used for manufacturing the stopper. The diameter should be neither too small nor too large. A second portion 415 should have a larger diameter in comparison to the first portion 414 to ensure that be sealing element is retained on the stopper. At the same time, the second portion 415 should have adequately smaller diameter than the mouth of the bottle so as to not hinder the bottling process. Furthermore, the fully assembled system has an overall conical shape to enable easy introduction of the system into the bottle. This result is furthered by the lower end of the inner component 430 having a tapered end.

It is to be noted once more that the fully assembled closure system with the tamperproof element can be bottled just by pressing and does not require rotating the stopper into the mouth of the bottle to achieve a sealed position. Since it does not require any complex method for bottling, it does not require complex and expensive bottling machinery, thereby reduces the overall cost of bottling.

Since the tamperproof element only requires a connection between the sealing element and the stopper, it can be used on a system having a sealing element and stopper in order to determine if the stopper has been moved with respect to the sealing element. Therefore, as can be envisaged by a person skilled in the art, the tamperproof element as described herein can be implemented on any system comprising such a stopper separate sealing element which can be assembled outside the bottle, and it is not limited to the stopper and sealing element as described in the context of the present invention.

Bottle/System with Special Mouth

In another embodiment of the invention, a bottle for use with the closure system of the present invention is provided.

Figure 26A:
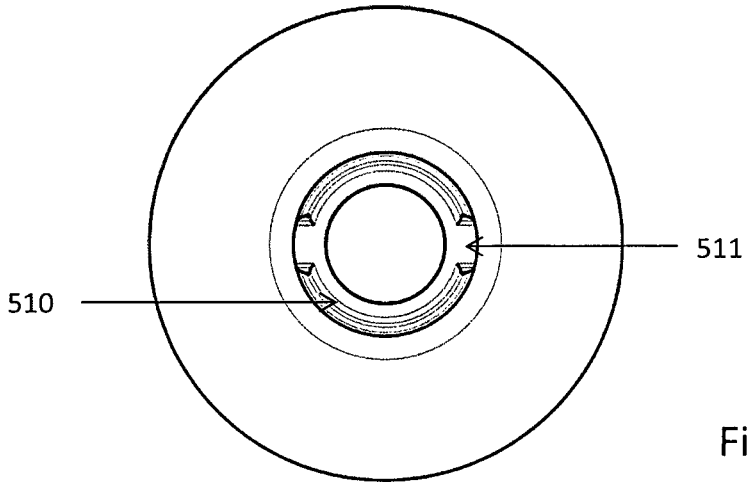
FIG. 26*a* shows a top view of the bottle in accordance with an embodiment of the invention.

FIG. 26*a* illustrates a top view of the bottle according to an embodiment of the invention. A ridge or a wall (510) is formed on the upper surface of the mouth of the bottle. This ridge is circular and runs around the upper surface of the mouth of the bottle to cover the entire perimeter of the upper surface of the mouth of the bottle. That is, the ridge runs along the total circular portion of the upper surface to complete itself back at the starting position.

However, as can be seen in FIG. 26*a*, the ridge can be broken (interrupted) at a number of different positions (511). In the present embodiment, the ridge is broken at two positions to form two substantially semicircular parts of the ridge, and the breaks provide two areas of the upper surface of the mouth of the bottle without a ridge or wall, the purpose of which will be explained subsequently.

Figure 26B:
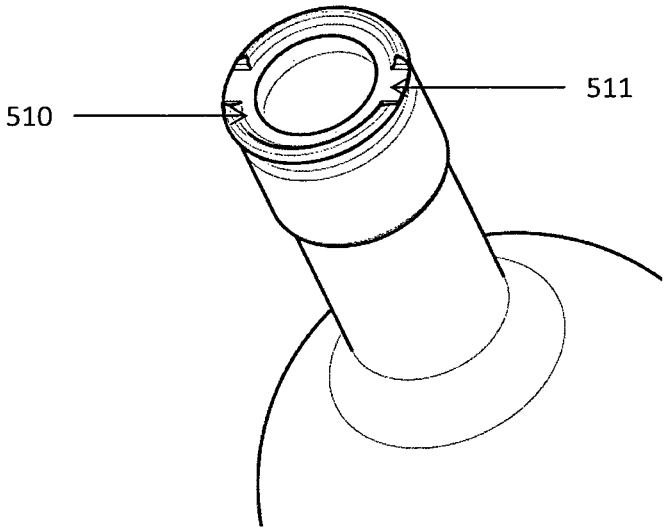
FIG. 26*b* shows an isometric view of the bottle in accordance with an embodiment of the invention.
Figure 26C:
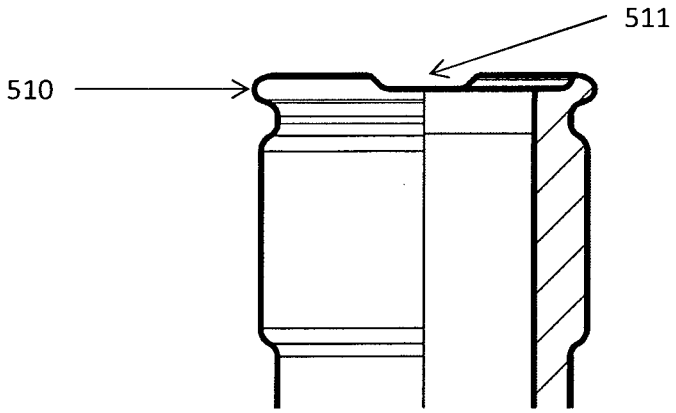
FIG. 26*c* shows a side view of the bottle in accordance with the embodiment of the invention.

The ridge is placed substantially away from the inner circumference of the mouth of the bottle. In the preferred embodiment as illustrated in FIGS. 26*a* and 26*b*, the ridge is placed on the outer extreme, such that the outer circumference of the outer side of the mouth of the bottle is in flush with the outer side of the mouth of the bottle. FIG. 26*c* shows a side view of the bottle showing the bottle neck and the ridge being flush.

FIG. 26*b* illustrates an angular side view of the bottle according to this embodiment. As can be seen in the figure, the ridge formed has a substantially triangular cross section. However, a skilled person may introduce a ridge in form of a wall having a rectangular or other cross section. The height of the ridge is preferably 1 mm, and it is spaced away from the inner circumference of the mouth of the bottle by at least 1 mm.

However, the dimensions may vary depending on the shape and size of the mouth of the bottle and the thickness of a sealing part of the bottle stopper, and thereby the height of the ridge or wall may preferably be anywhere between 1 mm and 2.5 mm, while the distance of the ridge from the inner circumference of the mouth of the bottle is preferably between 1 mm to any distance depending on the thickness of the mouth of the bottle.

The bottle as described above is advantageous in combination with any closure system having a stopper having a stopper part and a head part having a diameter that is larger than that of the stopper part, and a sealing element comprising a part adapted for sealing the head part of the stopper against the top (i.e. the upper) surface of the mouth. The stopper part of the stopper is introduced into the mouth of the bottle, and the head part of the stopper remains outside the bottle. In the case of the preferred embodiments of such a closure system as described above in relation with FIGS. 8, 18*a* and 18*b*, the part of the sealing element which is adapted for sealing the head part of the stopper against the top is called "upper part" (41, 421) of the sealing element. As it will be appreciated by the skilled person, the bottle described above can be used for any such closure system and not only for the closure systems as described above, where the stopper part comprises an interlocking mechanism for engaging with a counterpart interlocking mechanism of the sealing element, and where the interlocking mechanisms are configured to permit bringing the sealing element into an unsealed position by an unsealing action which comprises rotating the stopper with respect to the bottle. For example, the bottle can advantageously be used in combination with the prior art stopper as described in EP 1 456 092 B1.

With such a closure system, due to the thickness of the part of the sealing element which is adapted for sealing the head part of the stopper against the top, there may be a gap formed between the head part of the stopper and the mouth of the bottle. This may cause problems such as accumulation of dust or dirt on the sealing element through the gap formed between them, which might lead to health related issues. The gap may also be aesthetically unpleasing for the customer. In order to overcome these problems, the bottle as described earlier is provided with a ridge which is formed along the perimeter of the upper surface of its mouth, such that it covers at least partially the gap between the bottle and the stopper.

The inner diameter of the ridge should be greater than the outer diameter of the part of the sealing element which is adapted for sealing the head part of the stopper against the top, to ensure that part of the sealing element which is adapted for sealing the head part of the stopper against the top is well accommodated within the ridge.

Preferably, the height of the ridge is lesser than the thickness of part of the sealing element which is adapted for sealing the head part of the stopper against the top, such that the head part is not in direct contact with the bottle. In fact, the height of the ridge should be chosen such that when bottling, even on a forced pushing of the stopper into the bottle, the ridge is not damaged due to contact with the head part of the stopper.

The ridge may be broken at one or more positions in such a manner that it forms breaks (i.e. interruptions or cut-outs) which allow the placement of a strip of a tamper proof element as described above.

The number, the widths and the positions of the breaks on the ridge should be such that they can accommodate the number of strips with their positions and widths. In the preferred embodiment, the ridge has two breaks at diagonally opposite sides to accommodate a tamper proof element having two strips at the diagonally opposite sides. For a closure system having a tamper proof element as shown in FIGS. 24*b*, 24*c*, 24*d* and 24*e*, the ridge is provided with one, three, four or five breaks, respectively, equidistant from each other (in the case of three, four or five) in order to accommodate the strips on the tamper proof element.

When the strips of the tamper proof element are placed in the breaks of the ridge, the ridge also acts as an interlocking mechanism in the axial direction for the strips of the tamper proof element. Therefore, when the stopper is rotated in an axial direction, causing a rotation of the tamper proof element connected to the stopper, the strips break off due to the interlocking with the ridge.

Furthermore, the ridge on the mouth of the bottle, which reduces the space between the bottle and underside of the head of the stopper, makes it more difficult to insert a tool, e.g. a knife, to try to wedge the stopper out of the bottle without damaging the sealing element and/or tamper proof element. In other words, the ridge provides an extra protection against opening the bottle without this being noticeable for other parties. This in turn provides comfort for the consumer as well as for the wine producer because especially for higher end wines, it is not uncommon that, after the original wine has been consumed, cheaper wine is filled into the bottle carrying the label of the higher end wine, and the bottle is re-closed with the closure of the original bottle, which had been carefully removed when opening the bottle.

Thus, in this embodiment, the ridge provides the additional advantage of improving the tamper protection.

Sealing Element According to a Different Embodiment of the Invention

Another embodiment of the invention provides a sealing element having greatly improved sealing properties compared to a sealing element as known from the prior art, such as the one disclosed in the European patent EP 1 456 092 B1. A sealing element according to such an embodiment of the present invention comprises a sealing part for sealing a stopper part of the stopper against an inner wall of the mouth of the bottle in the sealed position. Preferably, it also comprises an upper part for sealing a head part of the stopper against a mouth of a bottle in a sealed position in the mouth of the bottle. Adjacent ribs are formed on an outer portion of the sealing part. The ribs are preferably located next to a junction between the second part and the first part. The two adjacent ribs are adapted to be pressed against the inner wall of the mouth of the bottle upon introducing the stopper part of the stopper into the sealed position. These adjacent ribs could be identical to those described with respect to FIGS. 8 and 9 or FIG. 18. When a sealing element according to this embodiment of the invention is provided on a stopper according to the prior art, such as the one disclosed in the European patent EP 1 456 092 B1, a more secure and reliable sealing than with the conventional sealing element used in combination with the stopper according to the prior art can be achieved.

The invention claimed is:

1. A method of sealing a bottle designed for commercial bottling of a beverage or liquid food using a system comprising a stopper and a sealing element, the stopper comprising a stopper part for introduction into a mouth of the bottle, and a head part for remaining outside the mouth, the head part having a diameter that is larger than that of the stopper part;

wherein the stopper part comprises an interlocking mechanism for engaging with a counterpart interlocking mechanism of the sealing element which is separate from the bottle; wherein the sealing element is configured to be forced against an inner wall of the mouth, thereby being brought into a sealed position, upon introducing the stopper part into the mouth, in which sealed position the stopper is held on the bottle by way of a frictional connection; and wherein the interlocking mechanisms are configured to permit bringing the sealing element into an unsealed position by an unsealing action which comprises rotating the stopper with respect to the bottle;

the method comprising the following steps:

assembling the system by introducing the stopper part of the stopper into the sealing element, and introducing the system into the mouth of the bottle until the sealed position is reached.

2. The method according claim 1, wherein the interlocking mechanism of the stopper comprises one or more screw threads; and wherein the one or more screw threads are broken longitudinally by one or more plain surfaces to accommodate parting lines.

3. The method according to claim 1, wherein the stopper part of the stopper is configured so that the sealing element, after being brought into the unsealed position, is retained on the stopper part of the stopper when the stopper is pulled out of the mouth.

4. The method according to claim 1, wherein a cavity is formed on the head part of the stopper; and wherein the cavity has a rectangular cross section when viewed from the top.

5. The method according to claim 1, wherein the sealing element comprises a sealing part being adapted to be pressed against an inner wall of the mouth, upon introducing the stopper part into the mouth;

wherein elements are formed on the outer side of the sealing part which are adapted to be pressed against the inner wall of the mouth in the sealed position and to build up an under-pressure or suction force in one or more areas between the sealing part and the inner wall of the mouth when the sealing element is brought into the sealed position; and wherein the elements formed on the outer side of the sealing part have the shape of adjacent ribs.

6. A system for sealing a bottle designed for commercial bottling of beverage a beverage or liquid food, the system comprising a stopper and a sealing element, the stopper comprising a stopper part for introduction into a mouth of the bottle, and a head part for remaining outside the mouth, the head part having a diameter that is larger than that of the stopper part;

wherein the stopper part comprises an interlocking mechanism for engaging with a counterpart interlocking mechanism of the sealing element, which is separate from the bottle;

wherein the sealing element is configured to be forced against an inner wall of the mouth, thereby being brought into a sealed position, upon introducing the stopper part into the mouth, in which sealed position the stopper is held on the bottle by way of a frictional connection; and wherein the interlocking mechanisms are configured to permit bringing the sealing element into an unsealed position by an unsealing action which comprises rotating the stopper with respect to the bottle; wherein, the system being designed to be assembled by introducing the stopper part of the stopper into the sealing element, and being introduced into the mouth of the bottle until the sealed position is reached.

7. The system according to claim 6, wherein the system configured to be introduced into the bottle by dropping the system into the mouth of the bottle.

8. The system according to claim 6, wherein the system being designed such that the system is in equilibrium when subject to gravity.

9. The system according to claim 6, wherein the system being designed such that the system when assembled has an overall conical shape.

* * * * *